US008322822B2

(12) United States Patent
Kanbe

(10) Patent No.: US 8,322,822 B2
(45) **Date of Patent: *Dec. 4, 2012**

(54) INK SUPPLY DEVICE AND METHOD OF DETERMINING TYPE OF INK CARTRIDGE

(75) Inventor: Tomohiro Kanbe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 319 days.

This patent is subject to a terminal disclaimer.

(21) Appl. No.: 12/730,009

(22) Filed: Mar. 23, 2010

(65) Prior Publication Data

US 2010/0245502 A1 Sep. 30, 2010

(30) Foreign Application Priority Data

Mar. 27, 2009 (JP) ..... 2009-080583

(51) Int. Cl.
*B41J 2/175* (2006.01)
*B41J 2/14* (2006.01)

(52) U.S. Cl. ..... 347/49; 347/86

(58) Field of Classification Search ..... 347/7, 19, 347/85, 86, 87
See application file for complete search history.

(56) References Cited

U.S. PATENT DOCUMENTS 5,844,580 A * 12/1998 Barinaga et al. ..... 347/7
5,997,121 A * 12/1999 Altfather et al. ..... 347/7
6,739,689 B2 * 5/2004 Choi ..... 347/19
7,562,972 B2 * 7/2009 Hattori et al. ..... 347/86
8,157,346 B2 * 4/2012 Nakamura ..... 347/19
2007/0048058 A1 3/2007 Koga et al.
2008/0180498 A1 7/2008 Hattori et al.

FOREIGN PATENT DOCUMENTS

JP 2005-288866 A 10/2005
JP 2007-090761 A 4/2007
JP 2008-246999 A 10/2008

* cited by examiner

*Primary Examiner* — Anh T. N. Vo
(74) *Attorney, Agent, or Firm* — Baker Botts L.L.P.

(57) ABSTRACT

An ink supply device includes a cartridge mounting portion to which an ink cartridge is configured to be mounted, a first detector configured to detect a first detection target portion of the ink cartridge and to output first detection information when the first detector detects the first detection target portion, a second detector configured to detect a second detection target portion of the ink cartridge and to output second detection information when the second detector detects the second detection target portion, and a controller configured to perform a first determination process of determining a type of the ink cartridge based on a temporal precedence between a time at which the first detector begins outputting the first detection information and a time at which the second detector begins outputting the second detection information during insertion of the ink cartridge into the cartridge mounting portion in an insertion direction.

14 Claims, 13 Drawing Sheets

INK SUPPLY DEVICE AND METHOD OF DETERMINING TYPE OF INK CARTRIDGE

CROSS REFERENCE TO RELATED APPLICATION

This application claims priority to and the benefit of Japanese Patent Application No. 2009-080583, which was filed on Mar. 27, 2009, the disclosure of which is incorporated herein by reference in its entirety.

BACKGROUND OF THE INVENTION

1. Field of the Invention

The present invention relates to an ink supply devices in which a controller is configured to determine a type of an ink cartridge based on a detector detecting a portion of the ink cartridge configured to be mounted to a cartridge mounting portion, and to a method of determining a type of an ink cartridge.

2. Description of Related Art

In a known inkjet recording apparatus such as an apparatus described in JP-A-2005-288866, an ink cartridge is positioned in the apparatus at a position outside a carriage on which the recording head is mounted, and the ink cartridge and the recording head are in fluid combination via a tube. The ink cartridge is configured to be removably mounted to a cartridge mounting portion by being inserted thereinto in a horizontal direction from the front side of the apparatus. When the ink cartridge is mounted to the cartridge mounting portion, an ink supply path from the ink cartridge to the recording head via the cartridge mounting portion is formed. Ink is supplied from the ink cartridge to the recording head through this ink supply path.

In another known inkjet recording apparatus such as an apparatus described in JP-2008-246999, detectors such as optical detectors are provided in the cartridge mounting portion for determining the type of the ink cartridge, e.g., determining the color or initial amount of ink stored in the ink cartridge. The ink cartridge has detection target portions positioned corresponding to the detectors, for determining the color or initial amount of ink. When the ink cartridge is inserted into the cartridge mounting portion and the detection target portions are detected by the detectors, signals are output from the detectors, and a controller of the apparatus performs a process of determining the type of the ink cartridge based on the signals. In this apparatus, the type of the ink cartridge is determined among two types. More specifically, the type of the ink cartridge is determined based on whether the level of the output signal of an optical detector detecting a detection target portion is greater than or equal to a predetermined value at a time at which another detector begins to detect another detection target portion.

SUMMARY OF THE INVENTION

A need has arisen for an ink supply device and a method of determining a type of an ink cartridge which overcome other shortcomings of the related art. A technical advantage of the present invention is that a type of an ink cartridge can be accurately determined.

According to an embodiment of the present invention, an ink supply device comprises a cartridge mounting portion to which an ink cartridge is configured to be mounted, a first detector configured to detect a first detection target portion of the ink cartridge and to output first detection information when the first detector detects the first detection target portion, a second detector configured to detect a second detection target portion of the ink cartridge and to output second detection information when the second detector detects the second detection target portion, and a controller configured to perform a first determination process of determining a type of the ink cartridge based on a temporal precedence between a time at which the first detector begins outputting the first detection information and a time at which the second detector begins outputting the second detection information during insertion of the ink cartridge into the cartridge mounting portion in an insertion direction.

According to another embodiment of the present invention, a method of determining a type of an ink cartridge configured to be mounted to a cartridge mounting portion, comprising a first step of storing in a storage medium first detection information output from a first detector positioned on the cartridge mounting portion during insertion of the ink cartridge into the cartridge mounting portion, a second step of storing in the storage medium second detection information output from a second detector positioned on the cartridge mounting portion during the insertion of the ink cartridge into the cartridge mounting portion, a third step of performing a first determination of determining the type of the ink cartridge, based on one of the first detection information and the second detection information that begins to be output earlier than the other of the first detection information and the second detection information begins to be output during the insertion of the ink cartridge into the cartridge mounting portion in the insertion direction, and a fourth step of determining that the ink cartridge has reached a predetermined mount position in the cartridge mounting portion based on both the first detection information and the second detection information stored in the storage medium.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

DETAILED DESCRIPTION OF EMBODIMENTS OF THE INVENTION

Embodiments of the present invention, and their features and advantages, may be understood by referring to FIGS. 1-13, like numerals being used for like corresponding parts in the various drawings.

Figure 1:
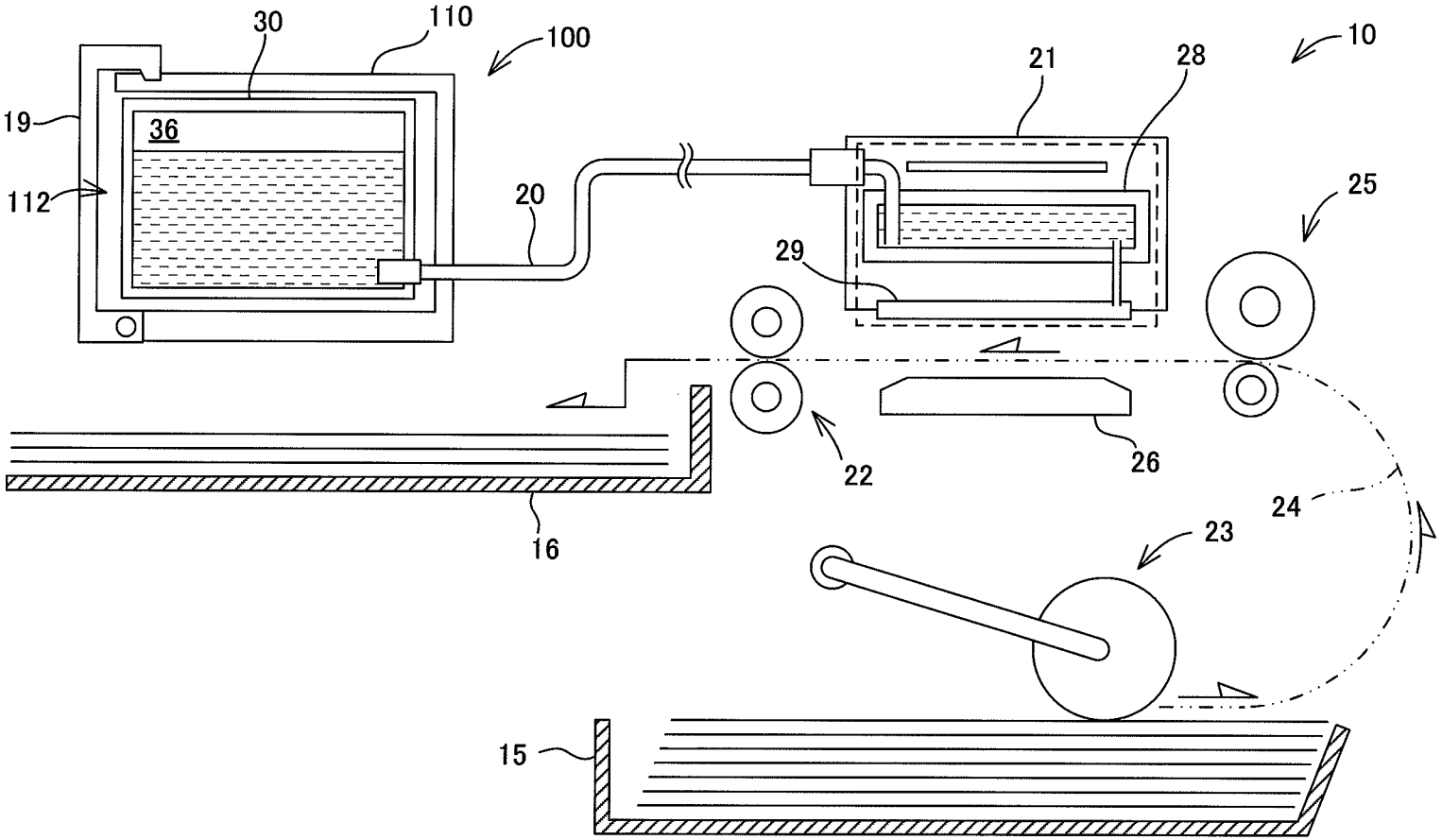
FIG. 1 is a schematic cross-sectional view of an internal structure of a printer according to an embodiment of the present invention.

Referring to FIG. 1, a printer 10 records an image by selectively ejecting ink droplets onto a recording sheet by using an inkjet printing method. As illustrated in FIG. 1, the printer 10 comprises an ink supply device 100. The ink supply device 100 comprises a cartridge holder 110 an example of a cartridge mounting portion. The cartridge holder 110 is configured to accommodate four ink cartridges 30. A cover 19 is pivotally supported on the cartridge holder 110 at a lower end of an opening 112, such that the cover 19 can be opened and closed. The cover 19 is configured to pivot about the lower end portion of the opening 112, whereby the position of the cover 19 is changed between an open position in which the opening 112 is exposed and a closed position in which the opening 112 is covered by the cover 19. The ink cartridges 30 are inserted into the cartridge holder 110 through the opening 112 horizontally.

Each of the ink cartridges 30 is configured to store ink that can be used in the printer 10. More specifically, cyan, magenta, yellow, and black inks are stored in the ink cartridges 30 corresponding to respective colors. The ink cartridge 30 is configured to be in fluid communication with a recording head 21 through an ink tube 20. The recording head 21 comprises a sub-tank 28 that temporarily stores ink. The recording head 21 is configured to selectively eject ink stored in the sub-tank 28 from nozzles 29 by using the inkjet printing method. When the ink is ejected, the pressure in the sub-tank 28 becomes less than the pressure in an ink chamber 36 of the ink cartridge 30. Thus, the ink is supplied from the ink cartridge 30 to the sub-tank 28 of the recording head 21 through the ink tube 20.

A sheet feed roller 23 is configured to feed a recording sheet from a first tray 15 to a transport path 24, and a pair of transport rollers 25 is configured to transport the recording sheet onto a platen 26. The recording head 21 is configured to eject ink onto the recording sheet passing over the platen 26. Thus, an image is printed on the recording sheet. A pair of discharge rollers 22 is configured to output the recording sheet, which has passed over the platen 26, onto a second tray 16 positioned at a downstream end of the transport path 24.

For the ink cartridge 30 storing ink of the same color, there are two types of ink cartridges 30 (30A and 30B) storing different initial amounts of ink. Examples of the types comprise a standard type for general users and a large volume type for heavy users who consume a large amount of ink. The initial amount of ink stored in a large volume type cartridge is greater than the initial amount of ink stored in a standard type cartridge. In this embodiment, the ink cartridge 30A is of the standard type, and the ink cartridge 30B is of the large volume type.

In the following description, the ink cartridges 30A and 30B will be collectively referred to as the ink cartridge 30, unless otherwise noted.

In the ink supply device 100, the ink cartridges 30A and 30B can be selectively inserted into and mounted to an accommodation space of the cartridge holder 110. The ink supply device 100 comprises a function of determining the type of the ink cartridge 30 mounted to the cartridge holder 110. In this embodiment, it is determined whether the ink cartridge 30 mounted to the cartridge holder 110 is the standard type or the large volume type. This determination is performed by a controller 90 provided in the ink supply device 100.

Figure 2A:
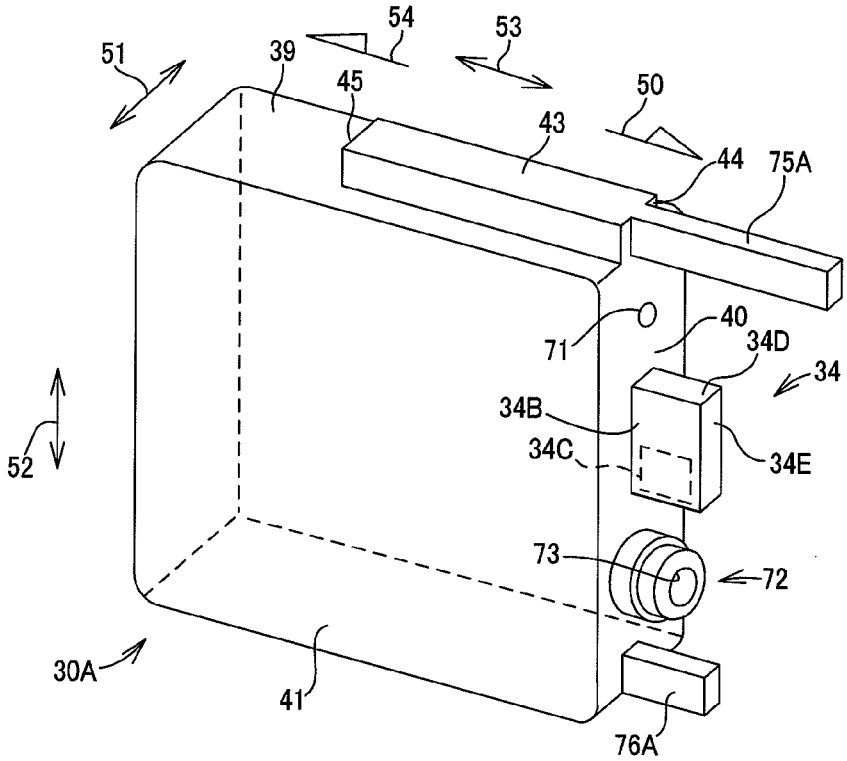
FIG. 2(A) is a perspective view of one type of an ink cartridge according to an embodiment of the present invention.

Referring to FIG. 2, the ink cartridge 30A comprises the ink chamber 36 formed therein, and the ink chamber 36 is configured to store ink therein. The ink cartridge 30A is inserted into the cartridge holder 110 in an upright position illustrated in FIG. 2(A), that is, in such a manner that the lower surface of the ink cartridge 30A in FIG. 2(A) faces downward and the upper surface of the ink cartridge 30A in FIG. 2(A) faces upward. The ink cartridge 30A is inserted into the cartridge holder 110 in a direction indicated by an arrow 50 (hereinafter referred to as an "insertion direction 50"). When the ink cartridge 30A is mounted to the cartridge holder 110, the ink cartridge 30A is in the upright position.

The ink cartridge 30A has substantially a rectangular-parallelepiped shape. More specifically, the ink cartridge 30A has a flat shape that has a small dimension in the width direction 51, and dimensions in the height direction 52 and in the depth direction 53, each of which is greater than the dimension in the width direction 51. The ink cartridge 30A is made of, for example, a translucent resin, e.g., transparent or semi-transparent resin through which light can pass. A rib 43 is positioned on an upper wall 39 of the ink cartridge 30A. An air communication opening 71, an ink supply portion 72, a first protrusion 75A, a second protrusion 76A, and an ink amount detection portion 34 are positioned at a front wall 40 of the ink cartridge 30A facing forward in the insertion direction 50 during insertion of the ink cartridge 30A into the cartridge holder 110.

Figure 2B:
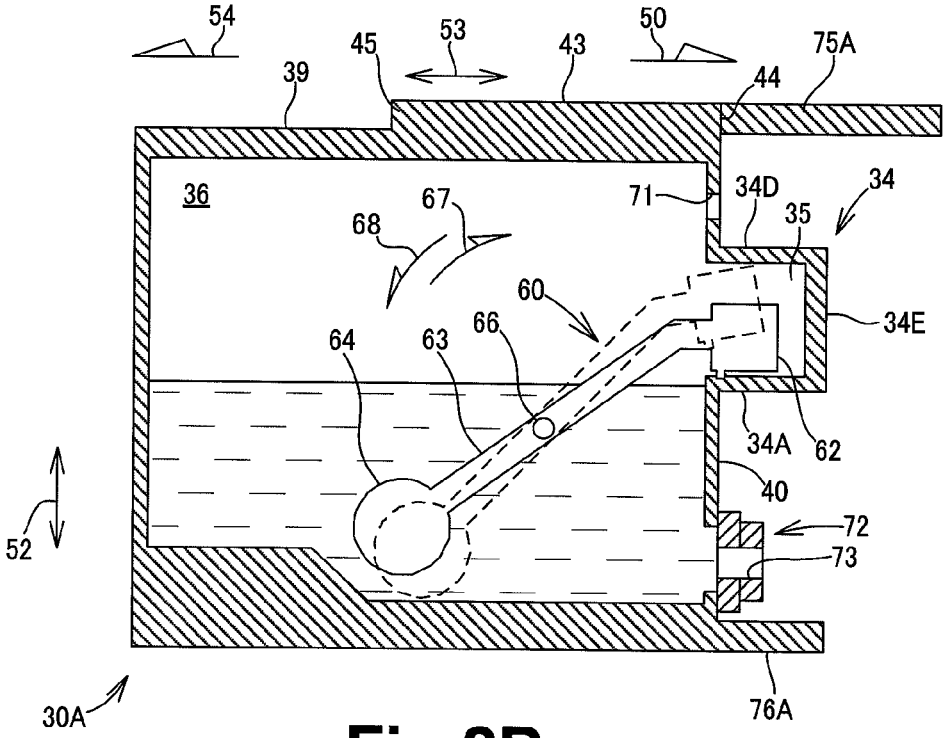
FIG. 2(B) is a vertical cross-sectional view of the ink cartridge.

Referring to FIG. 2(B), the ink amount detection portion 34 has substantially a rectangular-parallelepiped shape. The ink amount detection portion 34 protrudes outward (to the right side in FIG. 2(B)) from a middle portion of the front wall 40 with respect to the height direction 52. The ink amount detection portion 34 comprises an inner space 35 formed therein, and the inner space 35 is in fluid communication with the ink chamber 36. The inner space 35 is surrounded by a bottom wall 34A, side walls 34B, an upper wall 34D, and a front wall 34E of the ink amount detection portion 34. A light-blocking plate 62 of a detection arm 60, which will be described below, is inserted into the inner space 35.

The ink amount detection portion 34 is used for visually or optically detecting the amount of ink stored in the ink chamber 36. For this purpose, the ink amount detection portion 34 is formed of a translucent, e.g., transparent or semi-transparent material through which light, e.g., visible light or infrared light can pass. Thus, a user can look into the inner space 35 in the ink amount detection portion 34 from the outside of the ink amount detection portion 34. The distance between the side walls 34B, which is the width of the ink amount detection portion 34 in the width direction 51, is less than the width of the front wall 40 in the width direction 51. More specifically, the ink amount detection portion 34 has the width that allows the ink amount detection portion 34 to enter a detection area 115 of an optical detector 114 described below.

The detection arm 60 is positioned in the ink chamber 36. With the detection arm 60, the amount of ink stored in the ink chamber 36 can be detected from the outside of the ink cartridge 30A through the ink amount detection portion 34. The detection arm 60, which is made of a synthetic resin, comprises an arm body 63, the light-blocking plate 62, and a float 64.

The arm body 63 is pivotally supported by a supporting shaft 66 that is supported by the side walls 41 of the ink cartridge 30A. Thus, the detection arm 60 can pivot in the ink cartridge 30A in the directions of arrows 67 and 68.

The float 64 is positioned at an end of the arm body 63. The float 64 has, for example, a hollow formed therein, such that the float 64 can float on liquid, e.g., ink. Therefore, the float 64 moves up and down when the amount of ink stored in the ink chamber 36 increases and decreases. Thus, the detection arm 60 pivots according the movement of the float 64. Instead of providing the float 64 with a hollow formed therein, the entirety or a portion of a portion of the detection arm 60 from the supporting shaft 66 to the float 64 may be made of a material having a specific gravity less than the specific gravity of ink.

The light-blocking plate 62 is positioned at an end of the arm body 63 opposite the float 64. When the detection arm 60 pivots clockwise (in the direction of the arrow 67) in FIG. 2(B), the light-blocking plate 62 moves downward in the inner space 35. Then, the light-blocking plate 62 contacts the bottom wall 34A of the ink amount detection portion 34 and remains in a lower position (a position in which the light-blocking plate 62 contacts the bottom wall 34A of the ink amount detection portion 34, which is illustrated with a solid line in FIG. 2(B)). On the other hand, when the detection arm 60 pivots counterclockwise (in the direction of the arrow 68) in FIG. 2(B), the light-blocking plate 62 moves upward and away from the bottom wall 34A. Then, the light-blocking plate 62 contacts the upper wall 34D and remains in an upper position (a position in which the light-blocking plate 62 is positioned above and away from the bottom wall 34A and contacts the upper wall 34D, which is illustrated with a broken line in FIG. 2(B)). In FIG. 2(B), the position in which the light-blocking plate 62 contacts the bottom wall 34A is illustrated with the solid line, and the position in which the light-blocking plate 62 is away from the bottom wall 34A is illustrated with the broken line.

When the light-blocking plate 62 is in the lower position, the light-blocking plate 62 is aligned in the width direction 51 with an irradiation portion 34C positioned in a lower portion of the side walls 34B. That is, the light-blocking plate 62 and the irradiation portion 34C overlap each other in the width direction 51. On the other hand, when the light-blocking plate 62 is in the upper position, the light-blocking plate 62 is positioned above the irradiation portion 34C and is not aligned with the irradiation portion 34C in the width direction 31. That is, in the upper position, the light-blocking plate 62 and the irradiation portion 34C do not overlap each other in the width direction 51.

In this embodiment, when the amount of ink stored in the ink chamber 36 is greater than or equal to a predetermined amount, the buoyancy acts on the float 64, such that the detection arm 60 pivots in the direction of the arrow 67. Thus, the light-blocking plate 62 is moved toward the lower position and remains in the lower position. On the other hand, when the amount of ink stored in the ink chamber 36 is less than the predetermined amount, the gravity acts on the float 64, such that the detection arm 60 pivots in the direction of the arrow 68. Thus, the light-blocking plate 62 is moved toward the upper position and remains in the upper position. In this manner, the light-blocking plate 62 moves up and down in accordance with the amount of ink stored in the ink chamber 36, such that light, e.g., visible light or infrared light, from the optical detector 114 (described below) is blocked by the light-blocking plate 62 or is allowed to pass across the ink amount detection portion 34 in the width direction 51.

When the ink cartridge 30A is in a mount position in the cartridge holder 110, in which the ink cartridge 30 A is allowed to supply ink to the ink tube 20 via the cartridge holder 110, a light emitter of the optical detector 114 described below (see FIG. 4) emits light toward the irradiation portion 34C of the ink amount detection portion 34. When this occurs, if the light-blocking plate 62 is in the lower position (the position illustrated with the solid line in FIG. 2(B)), light is blocked by the light-blocking plate 62 in the inner space 35. On the other hand, if the light-blocking plate 62 is in the upper position (the position illustrated with the broken line in FIG. 2(B)), the light is not blocked by the light-blocking plate 62, and the light passes across the inner space 35 and reaches a light receiver of the optical detector 114. Therefore, whether the amount of ink stored in the ink chamber 36 is greater than the predetermined amount can be determined by analyzing the signal output from the light-blocking plate 62.

The air communication opening 71 is formed through the front wall 40 at a position above the ink amount detection portion 34. The ink chamber 36 communicates with the exterior of the ink cartridge 30A, i.e., with the atmosphere, through the air communication opening 71, such that air can be introduced into the ink chamber 36. The pressure in the ink chamber 36 is maintained at the atmospheric pressure, because the ink chamber 36 communicates with the atmosphere through the air communication opening 71.

The ink supply portion 72 is positioned at the front wall 40 below the ink amount detection portion 34. The ink supply portion 72 comprises an elastic annular member and protrudes outward (in the insertion direction 50) from the front wall 40. A through hole 73 is formed through a center portion of the ink supply portion 72. Ink is supplied from the ink chamber 36 to the exterior of the ink cartridge 30A through the through hole 73.

The ink cartridge 30A comprises the rib 43 extending in the depth direction 53. The rib 43 comprises two side walls extending upward from the upper wall 39 of the ink cartridge 30A and an upper wall connecting top sides of the side walls to each other. The width of the side walls of the rib 43 is less than the width of the upper wall 39 in the width direction 51. An end portion 44 of the rib 43 corresponds to an upper end of the front wall 40. An end portion 45 opposite the end portion 44 (on a rear side with respect to the insertion direction 50) is positioned in about the middle of the upper wall 39 with respect to the depth direction 53. When the ink cartridge 30A is mounted to the cartridge holder 110 in the mount position, a lock lever 145 described below contacts the end portion 45 of the rib 43.

The first protrusion 75A is positioned at an upper end of the front wall 40 when the ink cartridge 30 A is in the upright position illustrated in FIG. 2(A). The first protrusion 75A is integrally formed with the rib 43 of the ink cartridge 30A. The first protrusion 75A protrudes from the end portion 44 of the rib 43 in the insertion direction 50. That is, the first protrusion 75A protrudes in the insertion direction 50 from the upper end of the front wall 40 of the ink cartridge 30A. In the ink cartridge 30A, the first protrusion 75A protrudes further than the ink supply portion 72 and the second protrusion 76A in the insertion direction 50. In other words, the length of the first protrusion 75A in the insertion direction 50 (the distance between the front wall 40 and the end of the first protrusion 75A in the insertion direction 50) is greater than each of the length of the ink supply portion 72 in the insertion direction 50 (the distance between the front wall 40 and the end of the ink supply portion 72 in the insertion direction) and the length of the second protrusion 76A (the distance between the front wall 40 and the end of the second protrusion 76A in the insertion direction 50). The first protrusion 75A is positioned above the ink supply portion 72.

The first protrusion 75A is configured to be detected by an optical detector 123 described below. The first protrusion 75A is made of a material that blocks light. The dimension of the first protrusion 75A in the width direction 51 is less than the dimension of the rib 43 in the width direction 51. More specifically, the first protrusion 75A has a width that allows the first protrusion 75A to enter a detection area 124 of optical detector 123. During the insertion of the ink cartridge 30A into the cartridge holder 110 toward the mount position, the first protrusion 75A enters an optical path in the detection area 124 and blocks light.

The second protrusion 76A is positioned at a lower end of the front wall 40 when the ink cartridge 30 A is in the upright position illustrated in FIG. 2(A). The second protrusion 76A is integrally formed with the front wall 40. The second protrusion 76A is positioned below the ink supply portion 72, and protrudes outward from the front wall 40 (in the insertion direction 50). The first protrusion 75A and the second protrusion 76A are separated from each other in the height direction 52. The ink supply portion 72 is positioned between the first protrusion 75A and the second protrusion 76A. The second protrusion 76A protrudes further than the ink supply portion 72 from the front wall 40 in the insertion direction 50. That is, the length of the second protrusion 76A in the insertion direction 50 (the distance between the front wall 40 and the end of the second protrusion 76A in the insertion direction) is greater than the length of the ink supply portion 72 (the distance between the front wall 40 and the end of the ink supply portion 72 in the insertion direction). Therefore, even if the ink cartridge 30A is dropped with the front wall 40 facing downwards, the impact is applied to at least one of the first protrusion 75A and the second protrusion 76A when the ink cartridge 30 A contacts a surface. Because the impact is not directly applied to the ink supply portion 72, the ink supply portion 72 is protected from the impact.

The second protrusion 76A is configured to be detected by an optical detector 126 described below. The second protrusion 76A is made of a material blocks light. The dimension of the second protrusion 76A in the width direction 51 is less than the dimension of the rib 43 in the width direction 51. More specifically, the second protrusion 76A has a width that allows the second protrusion 76A to enter a detection area 127 of the optical detector 126. During the insertion of the ink cartridge 30A into the cartridge holder 110 toward the mount position, the second protrusion 76A enters the optical path in the detection area 127 and blocks light.

Figure 3A:
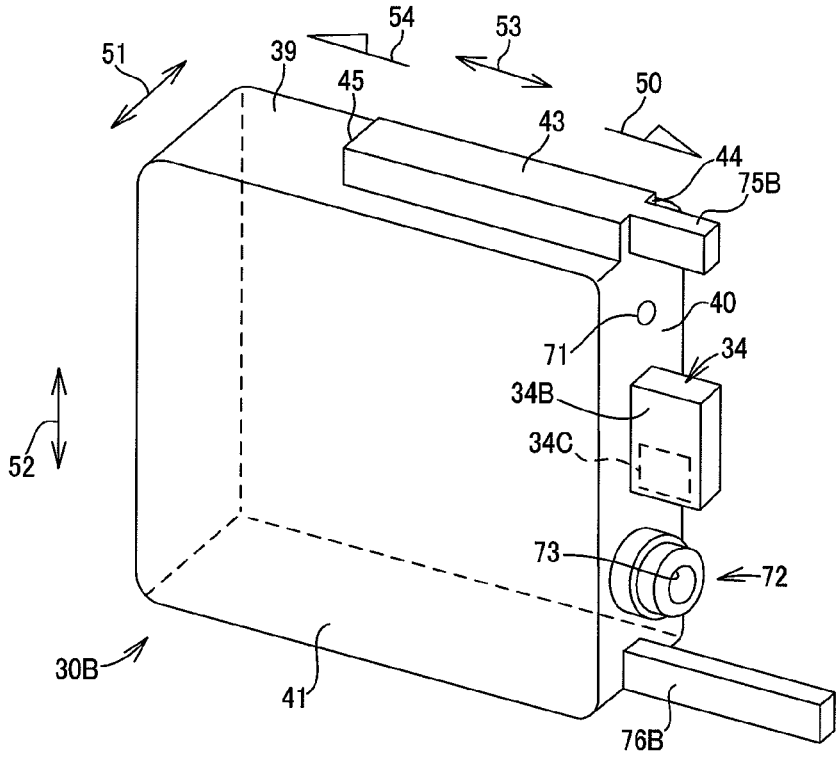
FIG. 3(A) is a perspective view of another type of an ink cartridge according to an embodiment of the present invention.
Figure 3B:
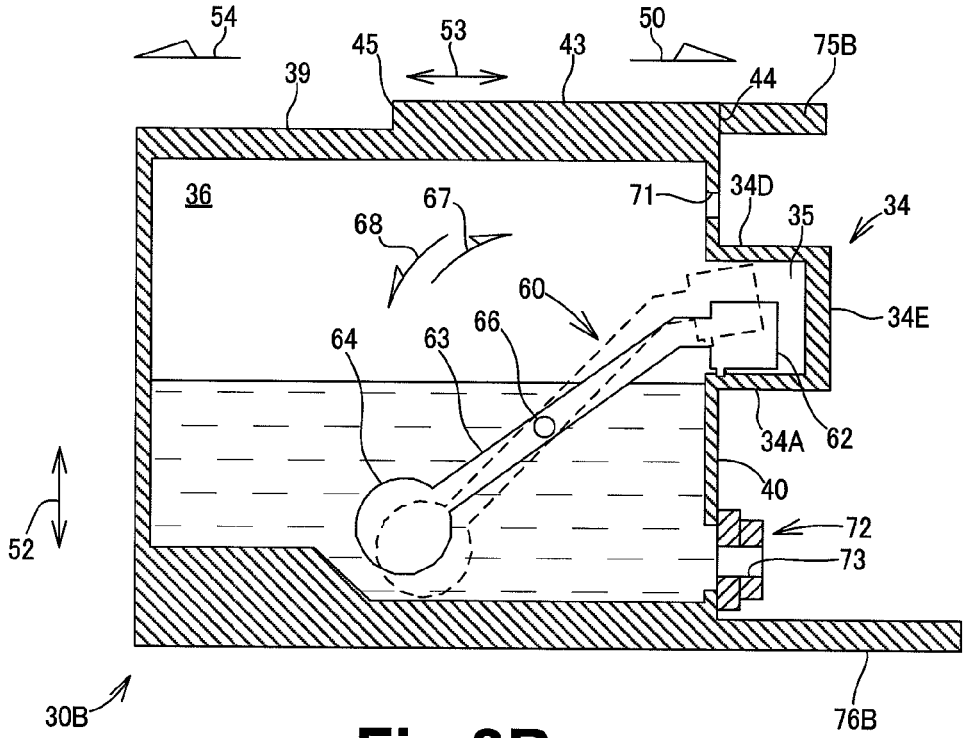
FIG. 3(B) is a vertical cross-sectional view of the ink cartridge.

Referring to FIGS. 3(A) and 3(B), the ink cartridge 30B will be described. The ink cartridge 30B differs from the ink cartridge 30A only in that the relation between the lengths of the first and second protrusions 75B and 76B of the ink cartridge 30B in the insertion direction 50 is opposite to that of the ink cartridge 30A. In other words, the length of the first protrusion 75A is greater than the length of the second protrusion 76A in the insertion direction 50 whereas the length of the first protrusion 75B is less than the length of the second protrusion 76B in the insertion direction 50 In other respects, the ink cartridges 30A and 30B have the same structure.

In the ink cartridge 30B, the length of the first protrusion 75B positioned at the upper end of the front wall 40 is less than the length of the second protrusion 76B in the insertion direction 50, and is the same as the length of the second protrusion 76A of the ink cartridge 30A in the insertion direction 50. On the other hand, the length of the second protrusion 76B positioned at the lower end of the front wall 40 is greater than the length of the first protrusion 75B in the insertion direction, and is the same as the length of the first protrusion 75A of the ink cartridge 30A in the insertion direction. The components of the ink cartridge 30B that are common to the ink cartridge 30A will be denoted by the same numerals and the description of such components will be omitted.

In the following description, unless otherwise noted, the first protrusion 75A of the ink cartridge 30A and the first protrusion 75B of the ink cartridge 30B will be collectively referred to as the first protrusion 75. The second protrusion 76A of the ink cartridge 30A and the second protrusion 76B of the ink cartridge 30B will be collectively referred to as the second protrusion 76.

Referring to FIG. 4, the ink supply device 100 is configured to supply ink to the recording head 21 (see FIG. 1) of the printer 10. The ink supply device 100 comprises the cartridge holder 110 to which four ink cartridges 30 can be mounted. The ink cartridge 30 is configured to be held in the cartridge holder 110. The cartridge holder 110 comprises the opening 112 formed therethrough, and the ink cartridge 30 is inserted into the cartridge holder 110 through the opening 112 horizontally.

A connection portion 121, which is to be connected to the ink supply portion 72, is positioned at a lower portion of an end wall 117 positioned opposite the opening 112, and an opening 119 is formed through the connection portion 121 and extends up to the exterior of the cartridge holder 110. The ink supply tube 122 having a cylindrical shape is attached to the connection portion 121. The ink supply tube 122 protrudes from the connection portion 121 toward the opening 112, that is, in a removal direction 54 opposite the insertion direction 50. The interior of the ink supply tube 122 is contiguous with the opening 119. The ink tube 20 (see FIG. 1) is connected to the exterior side of the opening 119. When the ink cartridge 30 is mounted to the cartridge holder 110 in the mount position, the ink supply portion 72 is connected to the connection portion 121. Thus, the ink supply tube 122 is inserted into the through hole 73 in the ink supply portion 72, and an ink path extending from the ink chamber 36 to the ink tube 20 via the through hole 73, the ink supply tube 122, and the opening 119 is formed.

The optical detector 114 is positioned at a middle portion of the end wall 117 of the cartridge holder 110 with respect to the height direction 52. The optical detector 114 is configured to detect the ink amount detection portion 34 of the ink cartridge 30 and the light-blocking plate 62 positioned in the ink amount detection portion 34, such that the controller 90 can determine the amount of ink stored in the ink cartridge 30. The optical detector 114 comprises a light emitter and a light receiver. The light emitter, such as a light emitting diode, can emit light such as visible light or infrared light. The light receiver, such as a phototransistor, can receive the light emitted by the light emitter. The light emitter and the light receiver are disposed in a substantially U-shaped resin case so as to face each other in the horizontal direction. In this embodiment, a light-transmission-detecting-type detector is used as the optical detector 114. In another embodiment, instead of the optical detector 114, a light-reflection-detecting-type detector can be used.

The optical detector 114 is electrically connected to the controller 90, and an electric signal output from the light receiver of the optical detector 114 is input to the controller 90. The level of the output signal corresponds to the intensity of light received by the light receiver. In this embodiment, when the ink cartridge 30 reaches a predetermined position before reaching the mount position in the cartridge holder 110, the irradiation portion 34C of the ink amount detection portion 34 begins entering the detection area 115 of the optical detector 114, which is an optical path extending from the light emitter to the light receiver. In this embodiment, the controller 90 is configured to determine whether the amount of ink stored in the ink chamber 36 is greater than or equal to the predetermined amount based on the output signal of the optical detector 114 when the ink amount detection portion 34 is in the detection area 115.

The optical detector 126 is positioned at a lower portion of the end wall 117 of the cartridge holder 110. The optical detector 126 is positioned corresponding to the second protrusion 76 of the ink cartridge 30. The optical detector 126 is configured to detect the second protrusion 76, so that the controller 90 can determine the type of the ink cartridge 30 mounted to the cartridge holder 110 and determine that the ink cartridge 30 has reached the mount position. The optical detector 126 has the same structure as the optical detector 114. The optical detector 126 comprises a light emitter and a light receiver. The light emitter can emit light such as visible light or infrared light. In this embodiment, a light-transmission-detecting-type detector is used as the optical detector 126. In another embodiment, instead of the optical detector 126, a light-reflection-detecting-type detector can be used.

The optical detector 126 is electrically connected to the controller 90. The light receiver of the optical detector 126 outputs an electric signal, and the output signal is input to the controller 90. In this embodiment, when the ink cartridge 30 reaches a predetermined position in the cartridge holder 110, the second protrusion 76 enters the detection area 127 of the optical detector 126, which is an optical path extending from the light emitter to the light receiver. Thus, light emitted by the light emitter is blocked, and the output signal of the light receiver, corresponding to the intensity of light received by the light receiver, of the optical detector 126 changes.

An optical detector 123, which has the same structure as the optical detectors 114 and 126, is positioned in an upper portion of the end wall 117 of the cartridge holder 110. The optical detector 123 is positioned corresponding to the first protrusion 75 of the ink cartridge 30. The optical detector 123 is configured to detect the first protrusion 75, such that the controller 90 can determine the type of the ink cartridge 30 mounted to the cartridge holder 110 and determine that the ink cartridge 30 has reached the mount position.

The optical detector 123 is electrically connected to the controller 90. The light receiver of the optical detector 123 outputs an electric signal, and the output signal is input to the controller 90. In this embodiment, when the ink cartridge 30 reaches a predetermined position in the cartridge holder 110, the first protrusion 75 enters a detection area 124 of the optical detector 123, which is an optical path extending from the light emitter to the light receiver. Thus, light emitted by the light emitter is blocked, and the output signal of the light receiver, corresponding to the intensity of light received by the light receiver, of the optical detector 123 changes.

The cartridge holder 110 comprises a lock mechanism 144. When the ink cartridge 30 is in the mount position, the lock mechanism 144 prevents the movement of the ink cartridge 30 in the removal direction 54 opposite the insertion direction 50, and fix (lock) the ink cartridge 30 in the mount position. The lock mechanism 144 is positioned on a side of the cartridge holder 110 opposite the side on which the optical detector 126 is positioned. In other words, the optical detector 126 and the lock mechanism 144 are positioned on a diagonal line of the vertical cross-section of the cartridge holder 110 at positions opposite each other. To be specific, the lock mechanism 144 is positioned above the opening 112.

The lock mechanism 144 comprises the lock lever 145 and a coil spring 148 configured to apply an urging force to the lock lever 145. The lock lever 145 is pivotally supported and configured to move between an unlock position illustrated in FIG. 4(B) and a lock position illustrated in FIG. 4(A). When an external force is not applied to the lock lever 145, the lock lever 145 is urged toward the lock position by the coil spring 148. An contact end 146 is formed at an end of the lock lever 145. When the contact end 146 of the lock mechanism 144 contacts the end portion 45 of the ink cartridge 30, the ink cartridge 30 is locked (fixed) to the cartridge holder 110 in the mount position. When the lock lever 145 is in the unlock position, the contact end 146 is above positioned the upper wall 39 of the ink cartridge 30. When the lock lever 145 is in the lock position, the contact end 146 is in contact with the upper wall 39.

An optical detector 141 is positioned adjacent to the lock mechanism 144. The optical detector 141, which has the same structure as those of the optical detectors 114 and 126 described above, has a detection area 142. A detection target portion 147 is positioned on a side of the lock lever 145 opposite the contact end 146 side. The optical detector 141 is positioned, such that the detection area 142 is positioned in the range of rotational movement of the detection target portion 147. Therefore, the detection target portion 147 can enter the detection area 142 depending on the position of the lock lever 145. In this embodiment, when the lock lever 145 is in the lock position, the detection target portion 147 is positioned in the detection area 142. When the lock lever 145 is in the unlock position, the detection target portion 147 is positioned outside the detection area 142. Whether or not the lock lever 145 is in the lock position can be determined based on an output signal of the optical detector 141, corresponding to the intensity of light received by the optical detector 141, when the detection target portion 147 enters the detection area 142 or moves away from the detection area 142.

Figure 4A:
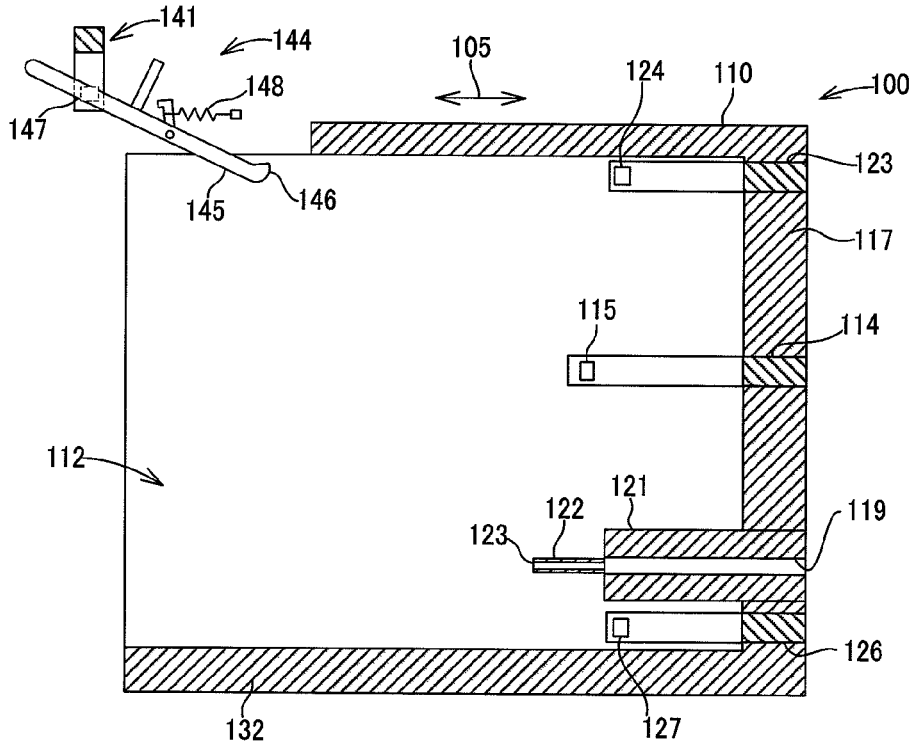
FIGS. 4(A) and 4(B) are vertical cross-sectional views of a cartridge holder according to an embodiment of the present invention, in which a lock lever is in a lock position in FIG. 4(A) and in an unlock position in FIG. 4(B).
Figure 4B:
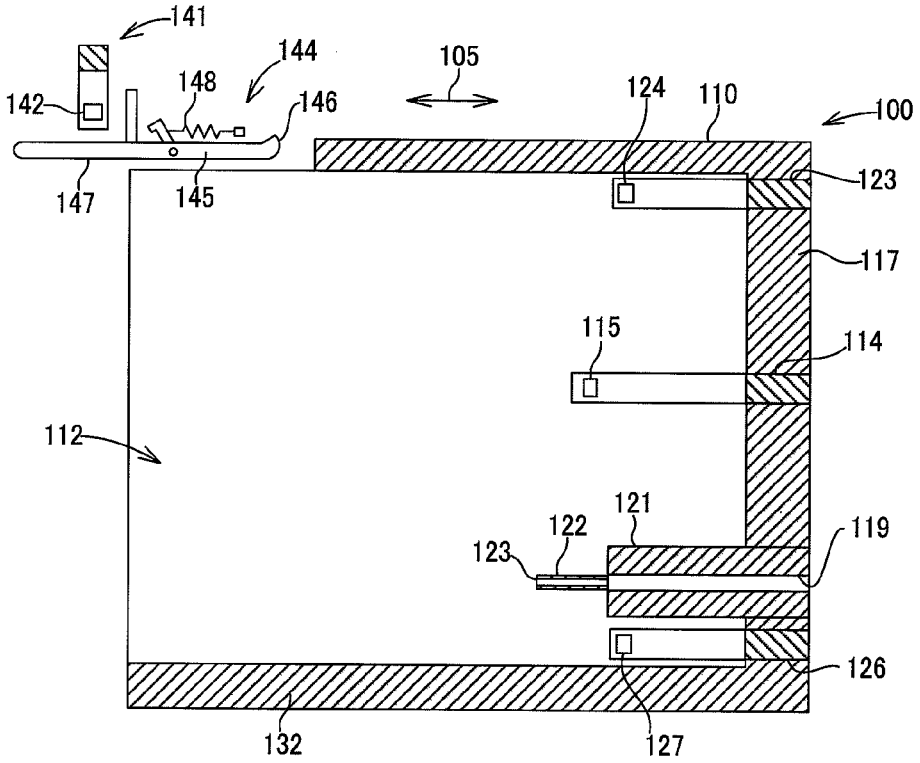
Figure 5A:
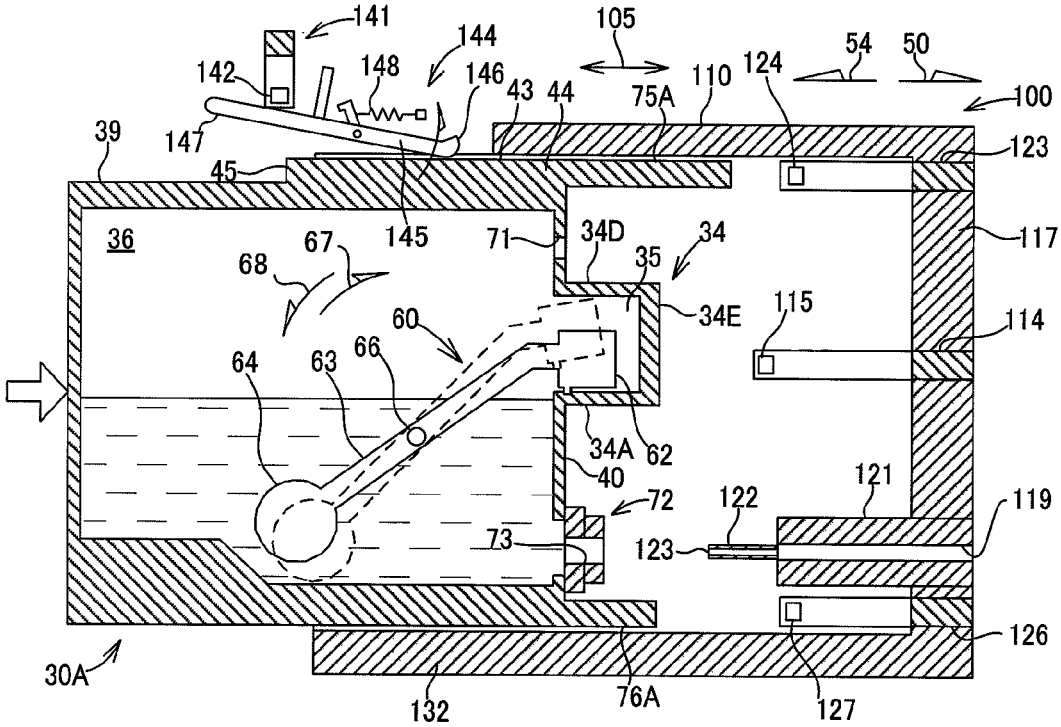
FIG. 5(A) is a vertical cross-sectional view of the ink cartridge of FIGS. 2(A) and 2(B) and the cartridge holder of FIGS. 4(A) and 4(B), in which the ink cartridge is inserted into the cartridge holder.

Referring to FIG. 5(A), when the ink cartridge 30A is inserted into the cartridge holder 110 in the insertion direction 50, the end of the first protrusion 75A contacts the contact end 146 of the lock lever 145. When the ink cartridge 30A is further inserted into the cartridge holder 110, the lock lever 145 pivots counterclockwise by the contact end 146 being pushed up, and the lock lever 145 pivots from the lock position (see FIG. 4(A)) to the unlock position (see FIG. 4(B)). The contact end 146, which has been pushed up, is positioned on the upper surface of the rib 43.

Before the ink cartridge 30A is inserted, the lock lever 145 is in the lock position (see FIG. 4(A)), and the detection target portion 147 of the lock lever 145 blocks light in the detection area 142. Therefore, the output signal of the optical detector 141 is a LOW level signal (see FIG. 7(A)). When the ink cartridge 30A is inserted and the lock lever 145 pivots to the unlock position (see FIG. 4(B)) as described above, the detection target portion 147 moves away from the detection area 142 while the lock lever 145 pivots. Therefore, the output signal of the optical detector 141 changes from the LOW level signal to a HI level signal (at T0 in FIG. 7(A)).

Figure 5B:
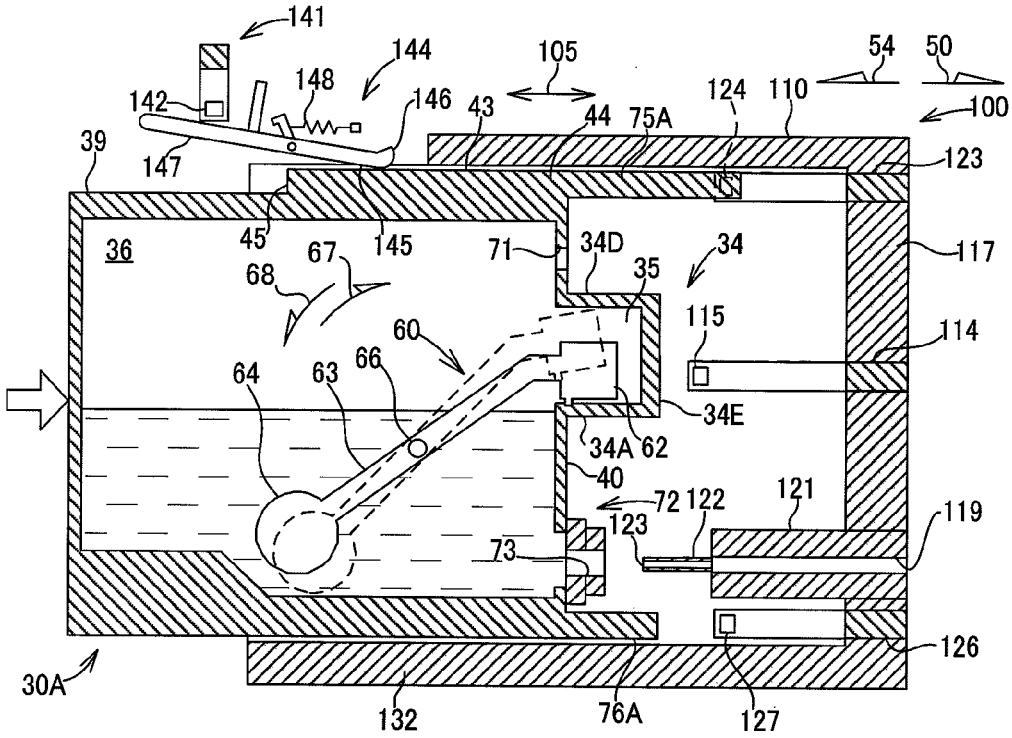
FIG. 5(B) is a vertical cross-sectional view of the ink cartridge and the cartridge holder, in which the ink cartridge is further inserted into the cartridge holder from the state shown in FIG. 5(A).

Referring to FIG. 5(B), when the ink cartridge 30A is further inserted, the first protrusion 75A enters the detection area 124 of the optical detector 123. When this occurs, the output signal of the optical detector 123 changes from a HI level signal to a LOW level signal (at T1 in FIG. 7(A)). The low level signal output from the optical detector 123 corresponds to first detection information. The controller 90 determines that the first protrusion 75A is detected by the optical detector 123 when the output signal of the optical detector 123 is the LOW level signal.

Figure 6A:
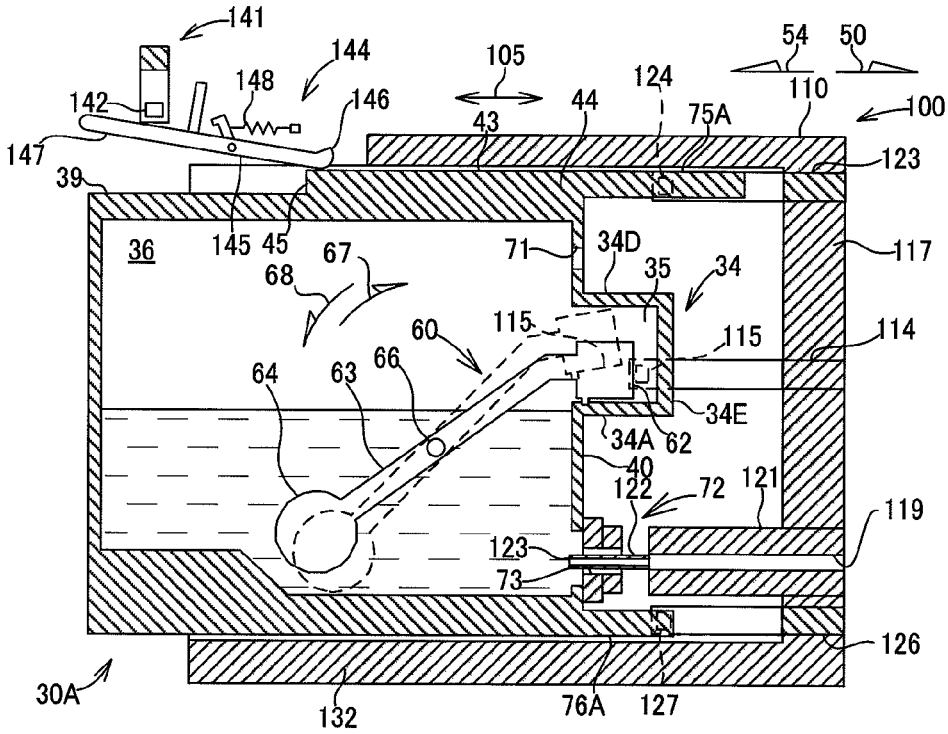
FIG. 6(A) is a vertical cross-sectional view of the ink cartridge and the cartridge holder, in which the ink cartridge is further inserted into the cartridge holder from the state shown in FIG. 5(B)

Referring to FIG. 6(A), when the ink cartridge 30A is inserted further, the front wall 34E of the detection portion 34 passes the detection area 115 of the optical detector 114. When this occurs, the output signal of the optical detector 114 temporarily changes from a HI level signal to a LOW level signal, and then changes from the LOW level signal to the HI level signal (at T2 and T3 in FIG. 7(A)). That is, the front wall 34E is detected by the optical detector 114. When the front wall 34E passes through the detection area 115, light travels through the front wall 34E in the width direction 51. A member, such as a cover or a film, made of a non-transparent material is attached to the front wall 34E. The light that travels through the front wall 34E in the width direction 51 is absorbed or reflected by the front wall 34E and thereby attenuated. Therefore, the intensity of light received by the light receiver is less than a predetermined amount, such that the output signal of the optical detector 114 is determined to be the LOW level signal. It is not necessary that the front wall 34E comprise the members described above. The front wall 34E may make the intensity of light received by the light receiver less than a predetermined amount by blocking or attenuating light emitted by the light emitter by altering the direction of the light by reflecting or diffracting all or a part of the light or by attenuating the light by using ground glass, a diaphragm, or a slit.

Referring to FIG. 6(A), before the ink cartridge 30A reaches the mount position, the second protrusion 76A enters the detection area 127 of the optical detector 126. The second protrusion 76A enters the detection area 127 at a time (at T4 in FIG. 7) that is Δt after the time at which the first protrusion 75A enters the detection area 124 of the optical detector 123 (T1 in FIG. 7). When this occurs, the output signal of the optical detector 126 changes from a HI level signal to a LOW level signal (at T4 in FIG. 7(A)). The LOW level signal output from the optical detector 126 corresponds to second detection information. The controller 90 determines that the second protrusion 76A is detected by the optical detector 126 when the output signal of the optical detector 126 is the LOW level signal.

Figure 6B:
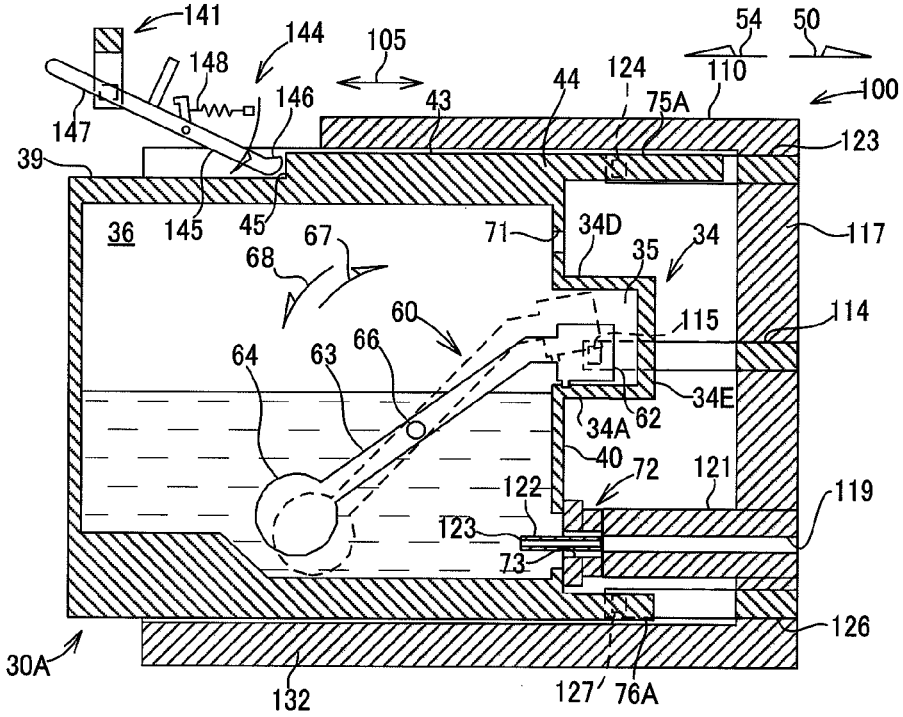
FIG. 6(B) is a vertical cross-sectional view of the ink cartridge and the cartridge holder, in which the ink cartridge is in a mount position.

Referring to FIG. 6(B), when the ink cartridge 30A is inserted further and the ink cartridge 30A reaches the mount position in the cartridge holder 110, the irradiation portion 34C of the detection portion 34 is positioned in the detection area 115 of the optical detector 114. The mount position is the position at which ink can be supplied from the ink cartridge 30A to the ink supply tube 122. In this embodiment, as illustrated in FIG. 6(B), the mount position is the position at which the ink supply portion 72 contacts the connection portion 121 and the ink supply tube 122 is inserted into the through hole 73.

Figure 7A:
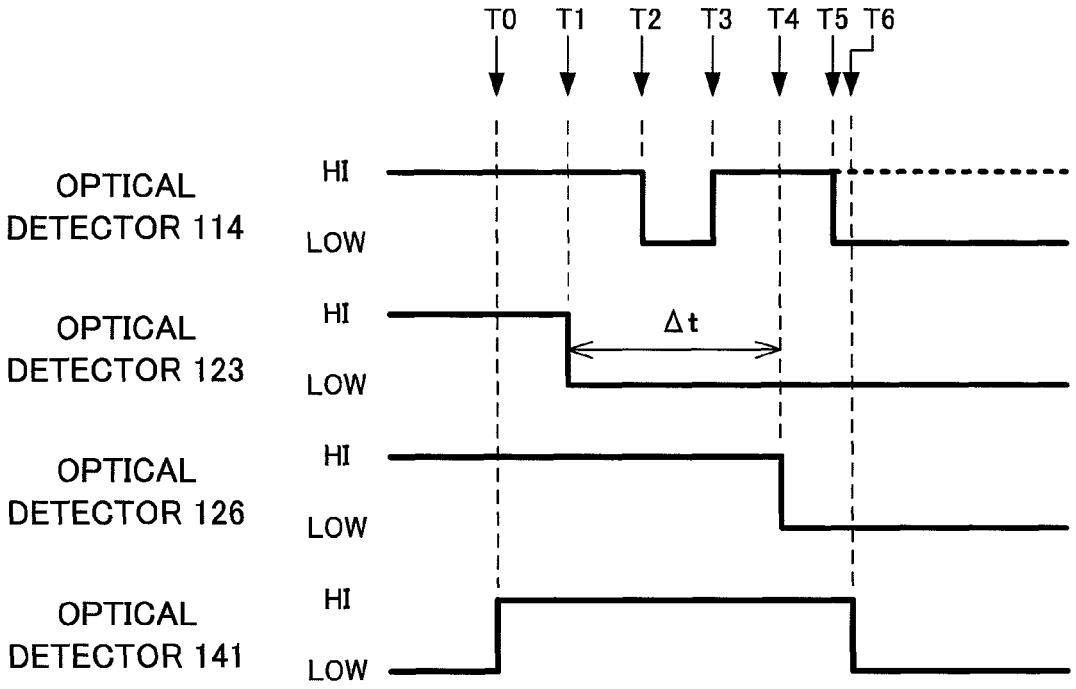
FIG. 7(A) is time profiles of output signals from four optical detectors during insertion of the ink cartridge of FIGS. 2(A) and 2(B) into the cartridge holder of FIGS. 4(A) and 4(B)
Figure 7B:
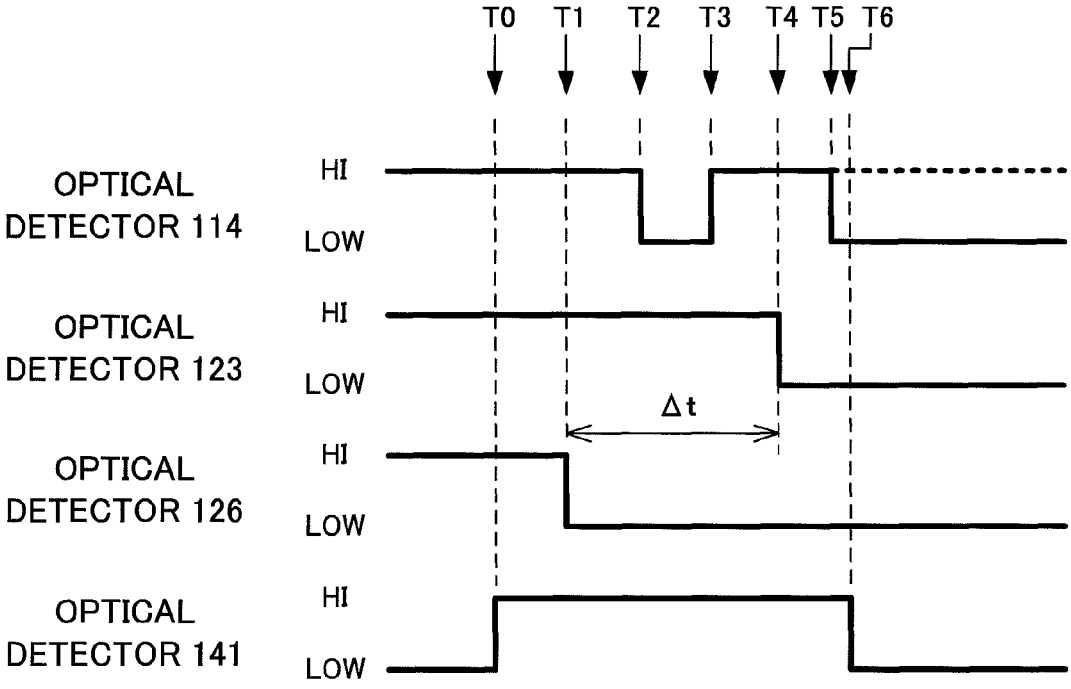
FIG. 7(B) is time profiles of output signals from four optical detectors during insertion of the ink cartridge of FIGS. 3(A) and 3(B) into the cartridge holder of FIGS. 4(A) and 4(B).

In a state in which the irradiation portion 34C is positioned in the detection area 115, if the amount of ink stored in the ink chamber 36 is greater than or equal to the predetermined amount, that is, if the light-blocking plate 62 is in the lower position (see the solid line in FIG. 6), the light-blocking plate 62 blocks light in the detection area 115. In this case, as illustrated in FIG. 7(A), the output signal of the optical detector 114 has changed from the HI level signal to the LOW level signal (at T5 in FIG. 7(A)). On the other hand, if the amount of ink stored in the ink chamber 36 is less than the predetermined amount, that is, if the light-blocking plate 62 is in the upper position (see the broken line in FIG. 6), the light-blocking plate 62 does not block light in the detection area 115. In this case, the output signal remains as the HI level signal (see the broken line in FIG. 7(A)).

When the ink cartridge 30A reaches the mount position, the end portion 45 of the rib 43 has passed the contact end 146 of the lock lever 145. When this occurs, the contact end 146 is not supported by the upper wall of the rib 43. Therefore, the lock lever 145 that has been pushed up pivots downward, and the contact end 146 contacts the upper surface of the upper wall 39 of the ink cartridge 30 and the end portion 45. Thus, the contact end 146 contacts the end portion 45, whereby the movement of the ink cartridge 30A in the removal direction 54 becomes prevented. At this time, the detection target portion 147 of the lock lever 145 blocks light in the detection area 142. Thus, the output signal of the optical detector 141 changes from the HI level signal to the LOW level signal (at T6 in FIG. 7(A)). This change in the output signal of the optical detector 141 from the HI level signal to the LOW level signal indicates that the position of the lock lever 145 has changed from the unlock position to the lock position.

Next, how the ink cartridge 30B is inserted into the cartridge holder 110 will be described. Description of how the ink cartridge 30B is inserted into the cartridge holder 110, which is the same as the description of how the ink cartridge 30A is inserted into the cartridge holder 110 will be omitted. During insertion of the ink cartridge 30B into the cartridge holder 110, the second protrusion 76B enters the detection area 127 of the optical detector 126 before the first protrusion 75B enters the detection area 124 of the optical detector 123. When this occurs, the output signal of the optical detector 126 changes from the HI level signal to the LOW level signal (at T1 in FIG. 7(B)). The LOW level signal output from the optical detector 126 corresponds to second detection information. The controller 90 determines that the second protrusion 76B is detected by the optical detector 126 when the output signal of the optical detector 126 is the LOW level signal.

When the ink cartridge 30B is inserted further, before the ink cartridge 30B reaches the mount position, the first protrusion 75B enters the detection area 124 of the optical detector 123. The first protrusion 75B enters the detection area 127 at a time (T4 in FIG. 7(B)) that is Δt after the time at which the second protrusion 76B enters the detection area 127 of the optical detector 126 (T1 in FIG. 7(B)). When this occurs, the output signal of the optical detector 123 changes from the HI level signal to the LOW level signal (at T4 in FIG. 7(B)). The LOW level signal output from the optical detector 123 corresponds to first detection information. The controller 90 determines that the first protrusion 75B is detected by the optical detector 123 when the output signal of the optical detector 123 is the LOW level signal.

Figure 8:
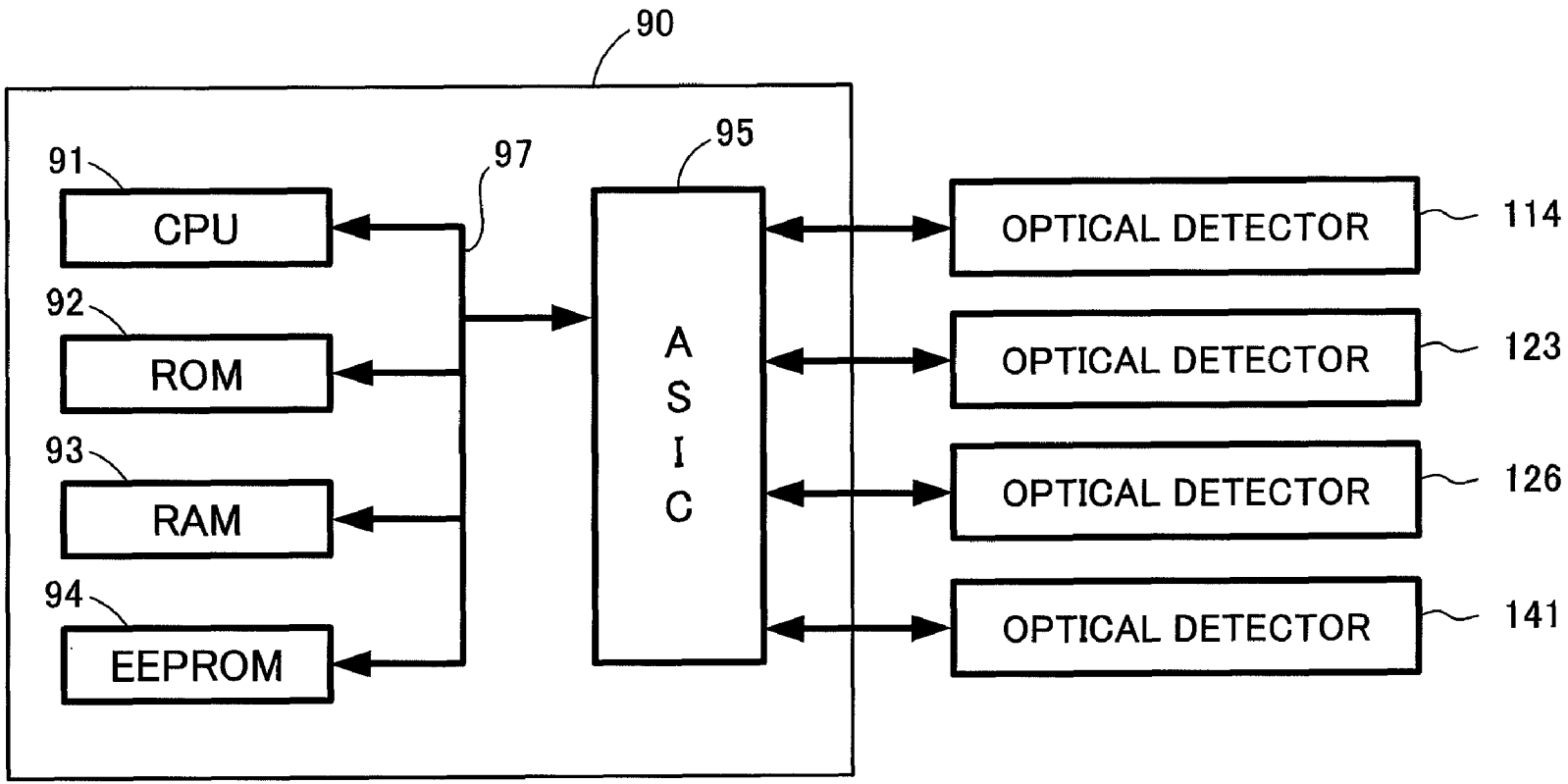
FIG. 8 is a block diagram of a configuration of a controller according to an embodiment of the present invention.

Referring to FIG. 8, the controller 90 is configured to control the overall operation of the printer 10. The controller 90 is a microcomputer comprising a CPU 91, a ROM 92, a RAM 93, an EEPROM 94, and an ASIC 95.

The ROM 92 is configured to store programs executed by the CPU 91 such as a program for controlling various operations of the printer 10 and a program for performing a determination process described below. The RAM 93 is configured to serve as a storage area for temporarily recording data and a signal that are used when the CPU 91 executes the programs and as a work area for data processing. The EEPROM 94 stores flags and the like that are to be stored after power off. For example, the EEPROM 94 stores data (look-up data) that represents the correspondence between the type of the ink cartridge 30 and the order of detection of the first protrusion 75 and the detection of the second protrusion 76. This data is used for determination performed in steps S3 and S6 described below.

The ASIC 95 is electrically connected to the optical detectors 114, 123, 126, and 141. Although not illustrated in FIG. 8, the ASIC 95 is also electrically connected to a driving circuit for driving rollers such as the sheet feed roller 23 and the pair of transport rollers 25 (see FIG. 1), an input section for inputting an image recording command to the printer 10, and a display for displaying information related to the printer 10.

Each of the optical detectors 114, 123, 126, and 141 outputs an analog electric signal (a voltage signal or a current signal) in accordance with the intensity of light received by the light receiver. The output signal is input to the controller 90. The controller 90 determines that the output signal is the HI level signal if the electrical level (the voltage or the current) is greater than or equal to a predetermined threshold and determines that the output signal is the LOW level signal if the electric level of the output signal is less than the predetermined threshold. In this embodiment, the output signal is determined to be the LOW level signal when light in the detection areas 115, 124, 127, and 142 of the optical detectors is blocked and determined to be the HI level signal when the light is not blocked.

Figure 9:
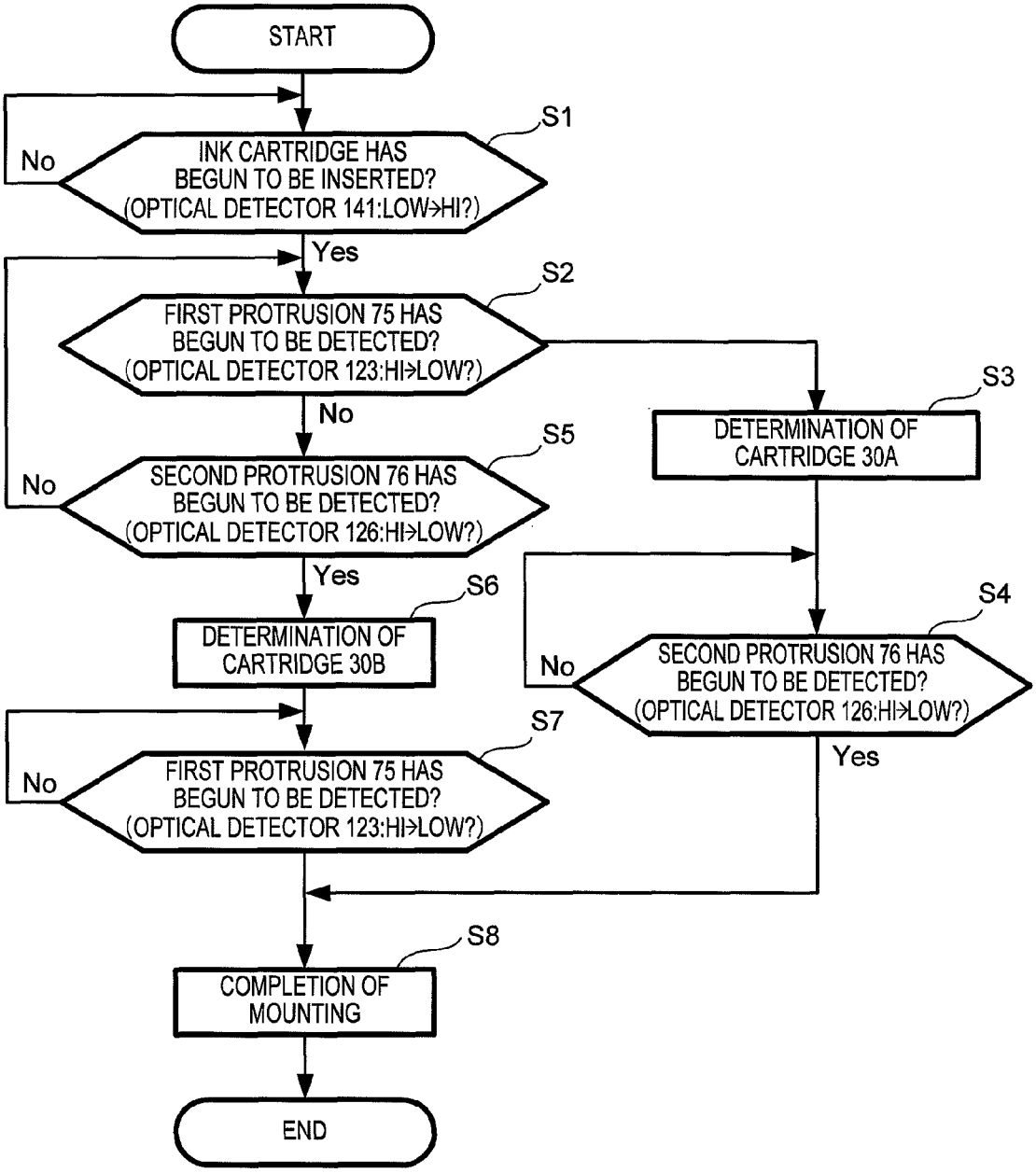
FIG. 9 is a flowchart of processes performed by the controller.

Referring to FIG. 9, the controller 90 is configured to perform a determination process of determining the type of the ink cartridge 30 mounted to the cartridge holder 110 based on the output signals of the optical detectors 114, 123, 126, and 141. In the determination process, the type of the ink cartridge 30 is determined based on the temporal precedence between the time at which the first protrusion 75 begins to be detected and the time at which the second protrusion 76 begins to be detected.

In step S1, the CPU 91 determines whether the ink cartridge 30 has begun to be inserted into the cartridge holder 110. As described above, when the ink cartridge 30 is inserted into the cartridge holder 110, the position of the lock lever 145 changes from the lock position to the unlock position, and the output signal of the optical detector 141 changes from the LOW level signal to the HI level signal (at T0 in FIG. 7). Therefore, in step S1, if the output signal of the optical detector 141 has changed from the LOW level signal to the HI level signal, it is determined that the ink cartridge 30 has begun to be inserted into the cartridge holder 110.

If it is determined that the ink cartridge 30 has begun to be inserted into the cartridge holder 110 in step S1 ("Yes" in S1), in the next step S2, the CPU 91 determines whether the first protrusion 75 has begun to be detected (S2). More specifically, if the output signal of the optical detector 123 has changes from the HI level signal to the LOW level signal, the first protrusion 75 has begun to be detected. If the first protrusion 75 is broken or the ink cartridge 30 is pulled out during the insertion, the first protrusion 75 cannot be detected. In this case, an error is output to a display after passage of a predetermined time.

If the first protrusion 75 has begun to be detected and if the second protrusion 76 has not yet begun to be detected, it is determined that the ink cartridge 30 that is inserted into the cartridge holder 110 is the ink cartridge 30A of the standard type (S3). In other words, if the first protrusion 75 begins to be detected before the second protrusion 76 begins to be detected, it is determined that the ink cartridge 30 that is inserted into the cartridge holder 110 is the ink cartridge 30A of the standard type. The result of the determination is stored in the RAM 93. If it is determined that the second protrusion 76 has begun to be detected after step S3 ("Yes" in S4), it is determined that the ink cartridge 30 has been completely mounted (S8). That is, if it is determined that both the first and second protrusions 75 and 76 are detected, it is determined that the ink cartridge 30 has reached the mount position. Thus, the controller 90 is ready to make the printer 10 start an image recording operation. The condition for determining the completion of mounting may comprise, in addition to detection of the first and second protrusions 75A and 76A, a change in the output signal of the optical detector 141 form the HI level signal to the LOW level signal, that is, a change in the position of the lock lever 145 from the unlock position to the lock position.

On the other hand, if it is not determined that the first protrusion 75 has begun to be detected in step S2 ("No" in S2), in the next step S5, the CPU 91 determines whether the second protrusion 76 has begun to be detected (S5). More specifically, if the output signal of the optical detector 126 has changed from the HI level signal to the LOW level signal, the second protrusion 76 has begun to be detected. If the second protrusion 76 is broken or the ink cartridge 30 is pulled out before being completely inserted, the second protrusion 76 cannot be detected. In this case, an error is output to a display after passage of a predetermined time.

If the second protrusion 76 has begun to be detected and if the first protrusion 75 has not yet begun to be detected, it is determined that the ink cartridge 30 that is inserted into the cartridge holder 110 is the ink cartridge 30B of the large volume type (S6). In other words, if the second protrusion 76 begins to be detected before the first protrusion 75 begins to be detected, it is determined that the ink cartridge 30 that is inserted is the ink cartridge 30B. The result of the determination is stored in the RAM 93. If it is determined that the first protrusion 75 has begun to be detected after step S6 ("Yes" in S7), it is determined that the ink cartridge 30 has been completely mounted (S8), and the printer 10 is ready to start an image recording operation.

As described above, during the insertion of the ink cartridge 30 into the cartridge holder 110, if the first protrusion 75 begins to be detected before the second protrusion 76 begins to be detected, it is determined that the ink cartridge 30 is the ink cartridge 30A, and, if the second protrusion 76 begins to be detected before the first protrusion 75 begins to be detected, it is determined that the ink cartridge 30 is the ink cartridge 30B. That is, the controller 90 determines the type of the ink cartridge 30 based on the temporal precedence between the time at which the first protrusion 75 begins to be detected and the time at which the second protrusion 76 begins to be detected. Thus, the type of the ink cartridge 30 can be accurately determined. By appropriately setting the lengths of the first protrusion 75 and the second protrusion 76 in the insertion direction, the time interval Δt in FIG. 7 can be relatively increased. Therefore, even if the ink cartridge 30 is rapidly inserted into the cartridge holder 110, the type of the ink cartridge 30 can be accurately determined.

In this embodiment, the first and second protrusions 75 and 76 are configured to prevent light from passing therethrough. However, the first and second protrusions 75 and 76 may be realized by using members that reduce the intensity of light that reaches the light receiver by altering the path of the light or by attenuating the light, such as slits, prisms, or translucent members.

In the embodiment described above, the first protrusion 75 and the second protrusion 76 are integrally formed with the case of the ink cartridge 30. However, in a modified embodiment, the first protrusion 75 and the second protrusion 76 may be configured to be removal from the front wall 40. For example, the ink cartridge 30 may be realized by removably attaching a square-bar shaped member to each of the upper end and the lower end of the front wall 40, the square-bar shaped members respectively corresponding to the first protrusion 75 and the second protrusion 76. In this case, by attaching a longer one of the square-bar shaped members to the upper end of the front wall 40 and attaching a shorter one of the square-bar shaped members to the lower end of the front wall 40, the ink cartridge 30A having the first protrusion 75A and the second protrusion 76A can be realized. By attaching a longer one of the square-bar shaped members to the lower end of the front wall 40 and attaching a shorter one of the square-bar shaped members to the upper end of the front wall 40, the ink cartridge 30B having the first protrusion 75B and the second protrusion 76B can be realized.

Figure 10:
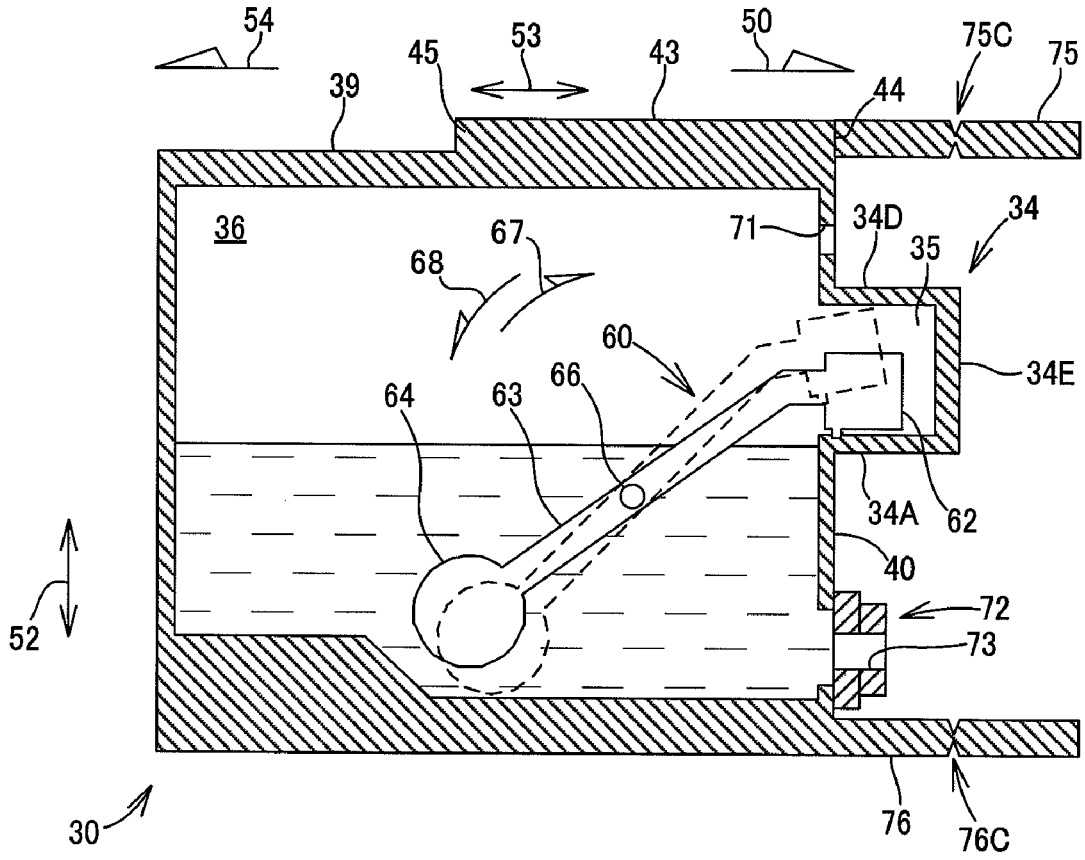
FIG. 10 is a vertical cross-sectional view of an ink cartridge according to a modified embodiment of the present invention.

Referring to FIG. 10, in another modified embodiment, protruding members that have the same length in the insertion direction 50 and protrude from the front wall 40 in the insertion direction 50 may be positioned at the upper end and at the lower end of the front wall 40, and the first protrusion 75 and the second protrusion 76 may be formed by breaking and removing an end portion of one of the protruding members. In this case, breakable grooves 75C and 76C are formed in the protruding members 75A and 75B, such that the protruding members can be easily broken. The breakable grooves 75C and 76C are formed at the same position in the insertion direction 50. The ink cartridge 30A comprising the first protrusion 75A and the second protrusion 76A can be realized by breaking the end portion of the protruding member positioned at the lower end of the front wall 40 and thereby reducing the length of the protruding member. The ink cartridge 30B comprising the first protrusion 75B and the second protrusion 76B can be realized by breaking the end portion of the protruding member positioned at the upper end of the front wall 40 and thereby reducing the length of the protruding member.

Figure 11A:
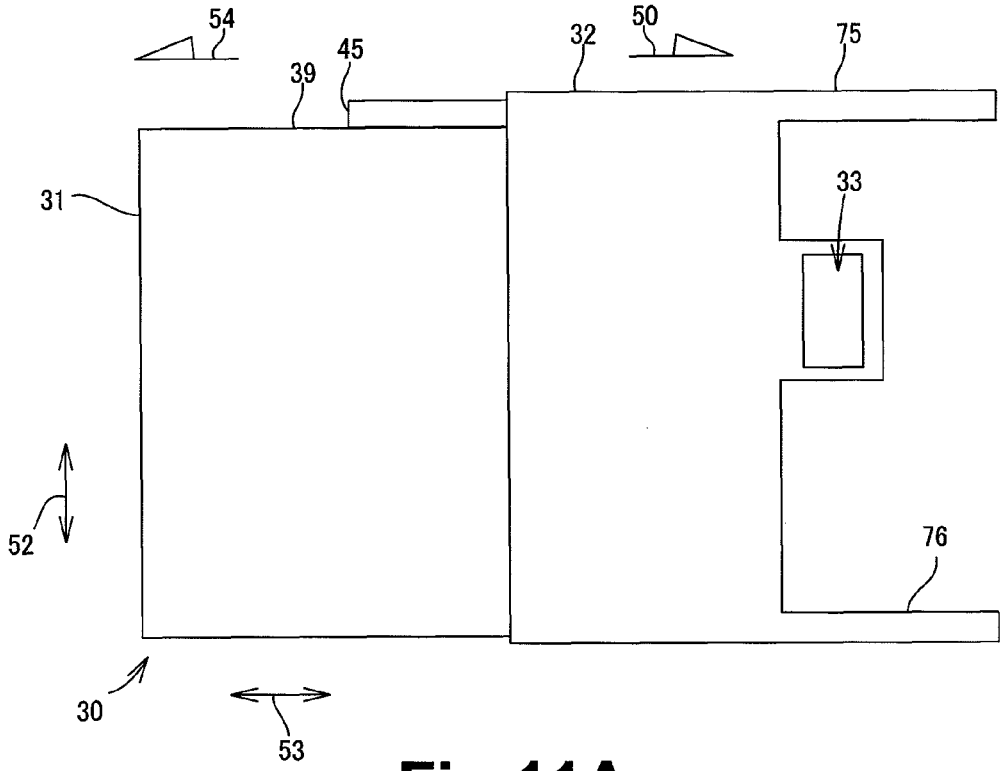
FIG. 11(A) is a side view of an ink cartridge according to another modified embodiment.
Figure 11B:
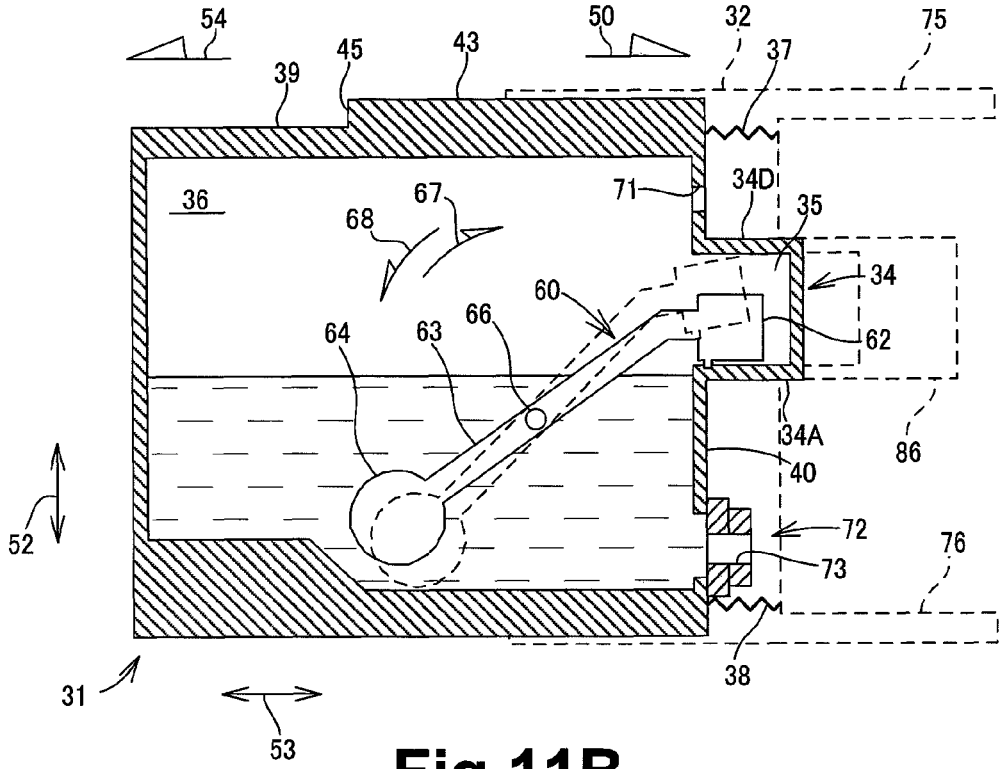
FIG. 11(B) is a vertical cross-sectional view of the ink cartridge.

Referring to FIG. 11, in yet another modification, the ink cartridge 30 comprises a cartridge body 31, which comprises the ink chamber 36 formed therein, and a cover 32 configured to cover the front wall 40 of the cartridge body 31 in the insertion direction 50.

Except that the cartridge body 31 does not comprise the first protrusion 75 and the second protrusion 76, the structure of the cartridge body 31 is the same as that of the ink cartridge 30 in the embodiment described above. Therefore, the cartridge body 31 has a substantially rectangular-parallelepiped shape that is narrow in the width direction 51, and the cartridge body 31 comprises the ink chamber 36 formed therein. At the front wall 40 of the cartridge body 31 in the insertion direction 50, the ink amount detection portion 34, the air communication opening 71, and the ink supply portion 72 are provided. Such components are the same as those of the embodiment described above, so that detailed description of such components will be omitted.

The cover 32 is a hollow box-shaped member that covers the front side of the cartridge body 31 in the insertion direction 50. The cover 32 is slidable along outer walls of the cartridge body 31 with respect to the insertion direction 50. Although not illustrated in the drawings, the cover 32 is configured to engage the cartridge body 31 at a position that is separated from the cartridge body 31 by a predetermined distance in the insertion direction 50, so that the sliding range of the cover 32 in the insertion direction 50 is limited. Coil spring 37 and 38 are positioned between the front wall 40 of the cartridge body 31 and the cover 32. The coil springs 37 and 38 urge the cover 32 in a direction away from the front wall 40 of the cartridge body 31, i.e., in the insertion direction 50.

At the front side of the cover 32 in the insertion direction 50, the first protrusion 75 and the second protrusion 76, which are similar to those described above, are positioned. Detailed description is omitted, because they are similar to those in the embodiment described above. A window 33 is formed through the cover 32 and extends through the cover 32 in the width direction 51 at a position near the center of the front side of the cover 32. When the cartridge body 31 is moved to a position closest to the cover 32, the ink amount detection portion 34 enters an area that corresponds to the window 33, such that the ink amount detection portion 34 is exposed to the outside of the cover 32 in the width direction 51. When the cover 32 is separated from the cartridge body 31, the ink amount detection portion 34 moves away from the area that corresponds to the window 33, such that the ink amount detection portion 34 is covered in the cover 32. The window 33 allows light of the optical detector 114 to pass therethrough.

Although not illustrated in the drawings, a through hole into which the connection portion 121 and the ink supply tube 122 can be inserted are formed through the front side of the cover 32 in the insertion direction 50 at a position that corresponds to the ink supply portion 72. The connection portion 121 and the ink supply tube 122 are connected to the ink supply portion 72 through the through hole.

Because the cover 32 is provided, if the ink cartridge 30 is dropped or collides with another member, the cover 32 protects the front side of the cartridge body 31 in the insertion direction 50. That is, the ink supply portion 72 and the ink amount detection portion 34 are prevented from being damaged. The controller 90 can perform the determination process of determining the type of the ink cartridge 30 that comprises the cover 32.

Figure 12A:
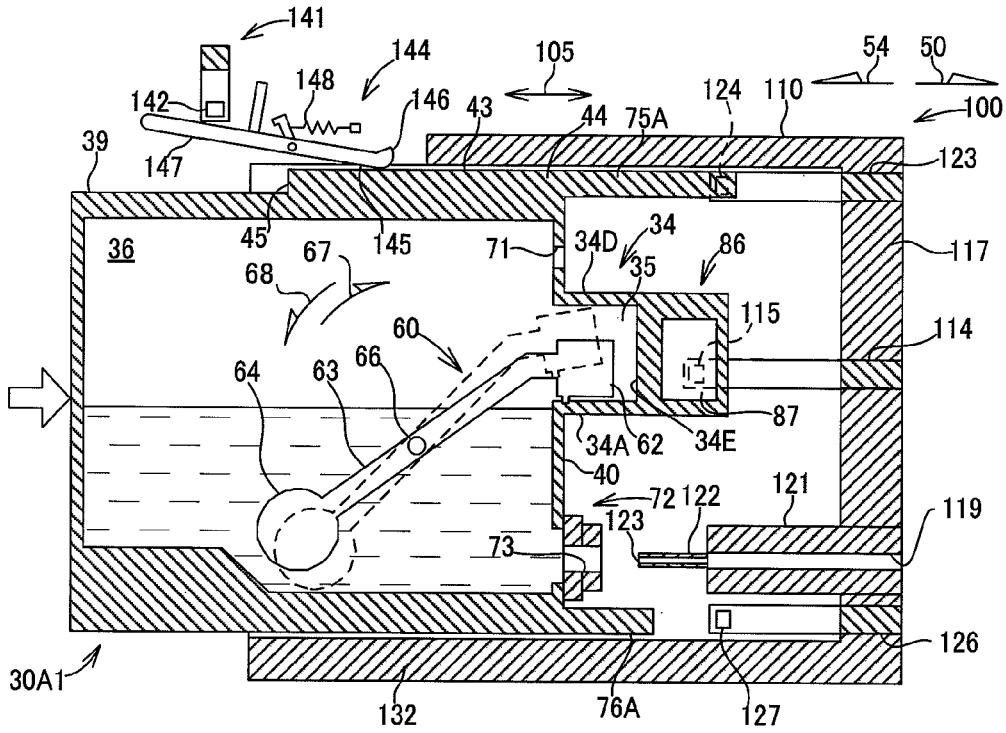
FIG. 12(A) is a vertical cross-sectional view of one type of ink cartridge according to yet another modified embodiment and the cartridge holder of FIGS. 4(A) and 4(B), in which the ink cartridge is inserted into the cartridge holder.
Figure 12B:
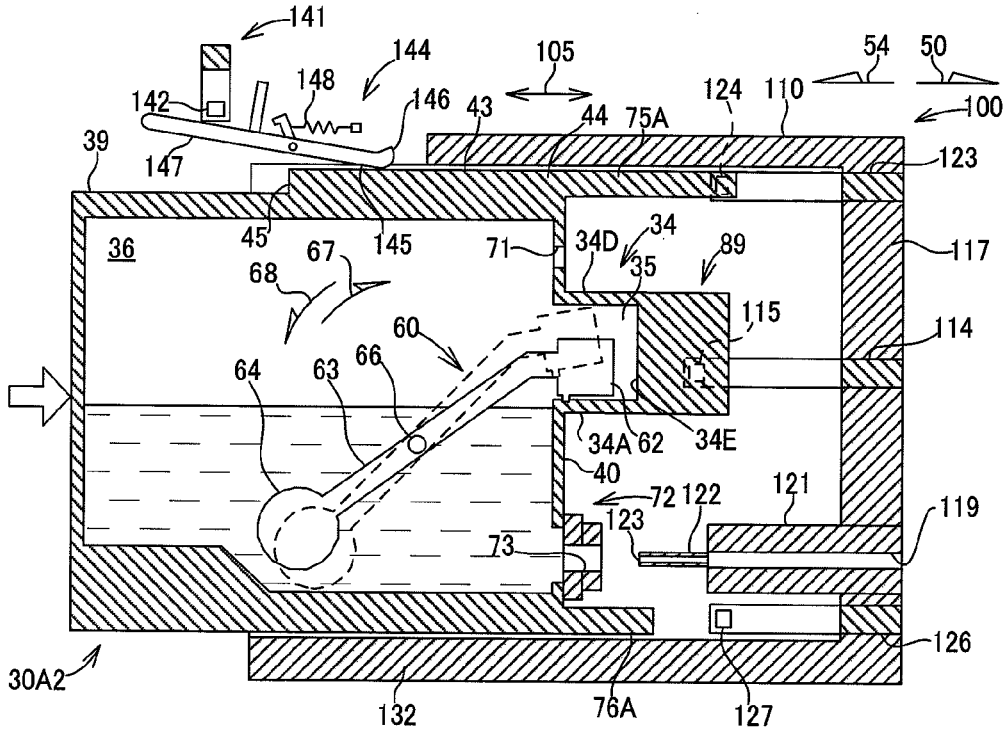
FIG. 12(B) is a vertical cross-sectional view of another type of the ink cartridge and the cartridge holder, in which the ink cartridge is inserted into the cartridge holder.

Referring to FIGS. 12(A) and 12(B), in still another modified embodiment of the embodiment, there are four types of ink cartridges 30A1, 30A2, 30B1 and 30B2. The ink cartridges 30B1 and 30B2 are not illustrated in any drawings. A type determination portion 86 is added to the ink cartridge 30A to realize the ink cartridge 30A1, and a type determination portion 89 is added to the ink cartridge 30A to realize the ink cartridge 30A2.

Referring to FIG. 12(A), the type determination portion 86 is integrally formed with the ink amount detection portion 34 of the ink cartridge 30A1 on the front side of the ink amount detection portion 34 in the insertion direction 50. As with the ink amount detection portion 34, the type determination portion 86 has a rectangular parallelepiped shape that is narrow in the width direction 51. The width (the dimension in the width direction 51) of the type determination portion 86 is less than the width of the front wall 40, such that the type determination portion 86 can enter the detection area 115 of the optical detector 114. The type determination portion 86 is formed of an opaque material that does not allow light to pass therethrough in the width direction 51. The type determination portion 86 has a shape that corresponds to the type of the ink cartridge 30A1. More specifically, a window 87 is formed through the type determination portion 86 of the ink cartridge 30A1 in the width direction 51. The window 87 is positioned at a height corresponding to the irradiation portion 34C of the ink amount detection portion 34. During insertion of the ink cartridge 30A1 into the cartridge holder 110, the window 87 enters the detection area 115 of the optical detector 114. The window 87 of the type determination portion 86 is in the detection area 115 when the first protrusion 75A begins to be detected by the optical detector 123. In this state, light passes through the window 87 and reaches the light receiver.

Referring to FIG. 12(B), the type determination portion 89 of the ink cartridge 30A2 is similar to the type determination portion 86 except that the type determination portion 89 does not have the window 87. During the insertion of the ink cartridge 30A2 into the cartridge holder 110, the type determination portion 89 enters the detection area 115 of the optical detector 114 and blocks light. The type determination portion 89 is in the detection area 115 when the first protrusion 75A begins to be detected by the optical detector 123.

When the ink cartridge 30A1 is inserted into the cartridge holder 110 and the first protrusion 75A begins to be detected, the output signal of the optical detector 114 is the HI level signal. Based on this, the controller 90 determines the type of the ink cartridge 30 by referring to the look-up table stored in the ROM 92. When the ink cartridge 30A2 is inserted into the cartridge holder 110 and the first protrusion 75A begins to be detected, the output signal of the optical detector 114 is the LOW level signal. Based on this, the controller 90 determines the type of the ink cartridge 30 by referring to the look-up table stored in the ROM 92. In this embodiment, for example, the ink cartridge 30A1 stores pigment-based ink, and the ink cartridge 30A2 stores dye-based ink. Therefore, in this case, whether the ink cartridge 30A stores the pigment-based ink or the dye-based ink can be determined in the determination process. Ejection of ink from the recording head 21 is controlled in different ways depending on whether the ink is a pigment ink or a dye ink.

Similarly, a type determination portion 86 is added to the ink cartridge 30B to realize the ink cartridge 30B1, and a type determination portion 89 is added to the ink cartridge 30B to realize the ink cartridge 30B2. The ink cartridge 30B1 stores pigment-based ink, and the ink cartridge 30B2 stores dye-based ink. Therefore, the controller 90 is configured to determine the type of the ink cartridge 30 among the standard-type ink cartridge 30A1 storing pigment-based ink, the standard-type ink cartridge 30A2 storing dye-based ink, the large volume type ink cartridge 30B1 storing pigment-based ink, and the large volume type ink cartridge 30B2 storing the dye-based ink.

Figure 13:
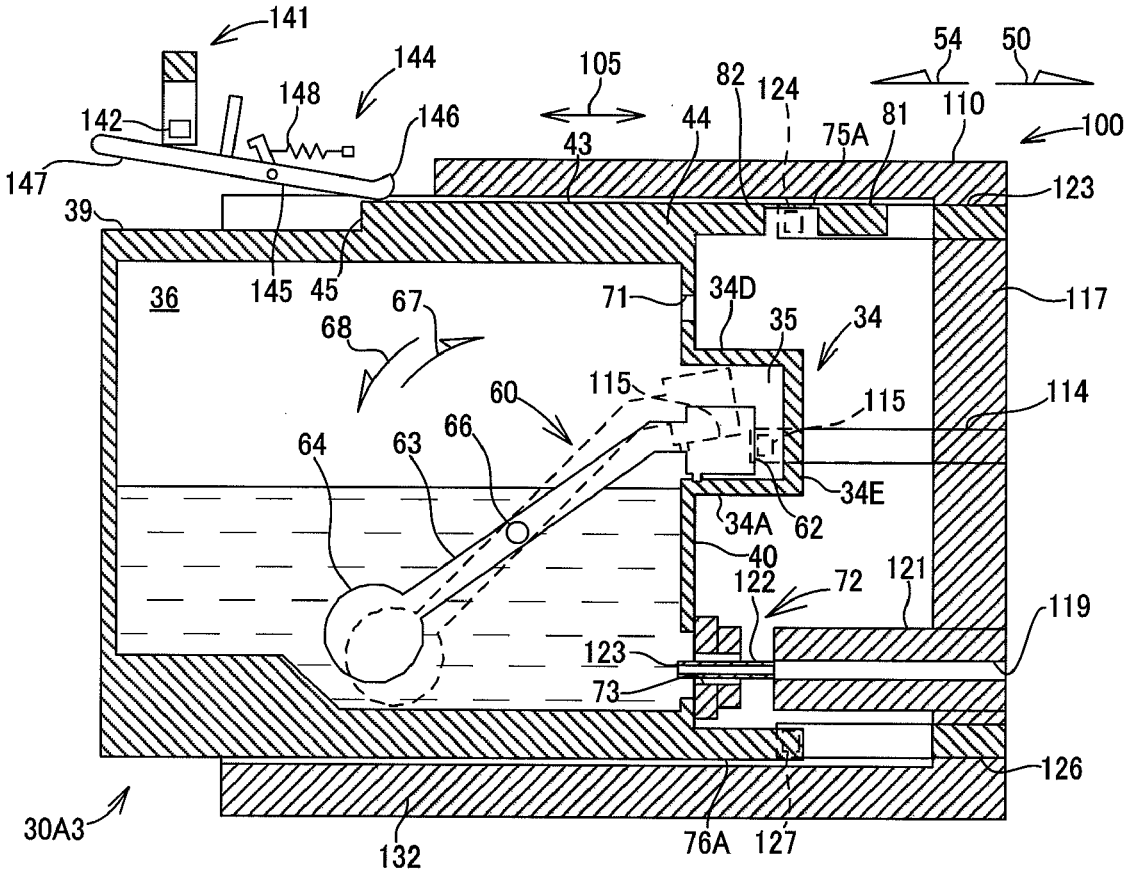
FIG. 13 is a vertical cross-sectional view of an ink cartridge according to still another embodiment and the cartridge holder of FIGS. 4(A) and 4(B), in which the ink cartridge is inserted into the cartridge holder.

Referring to FIG. 13, in a further modified embodiment, an ink cartridge 30A3 has a cutout 82 formed in is formed through the first protrusion 75A of the ink cartridge 30A.

The cutout 82 is positioned separated from the end of the first protrusion 75A by a predetermined distance in the removal direction 54 toward the front wall 40. A light blocking portion 81, which is configured to block light, is positioned between cutout 82 and the end of the first protrusion 75A in the insertion direction 50. During the insertion of the ink cartridge 30A3 into the cartridge holder 110 toward the mount position, the light blocking portion 81 moves across the detection area 124 so as to block the light that passes through the detection area 124 toward the light receiver of the optical detector 123. When the light blocking portion 81 moves across the detection area 124, the light is blocked. The cutout 82 is positioned in the detection area 124 when the second protrusion 76A of the ink cartridge 30A3, which is shorter than the first protrusion 75A, begins to be detected by the optical detector 126. When this occurs, light emitted by the light emitter of the optical detector 123 passes through the cutout 82 and enters the light receiver of the optical detector 123 without being blocked by the first protrusion 75A. That is, the cutout 82 allows the light traveling toward the light emitter of the optical detector 123 to pass therethrough. In another embodiment, instead of the cutout 82, a member having a property of transmitting light, such as glass or a transparent resin plate may be used.

When the ink cartridge 30A3 is inserted into the cartridge holder 110 and the second protrusion 76A begins to be detected by the optical detector 126, the output signal of the optical detector 123 is the HI level signal. Based on this, the controller 90 determines the type of the ink cartridge 30A by referring to the look-up table stored in the ROM 92. When the ink cartridge 30A is inserted into the cartridge holder 110 and the second protrusion 76A begins to be detected by the optical detector 126, the output signal of the optical detector 123 is the LOW level signal, because the first protrusion 75A of the ink cartridge 30A does not have the cut-out 82 formed therethrough, and the intensity of the light of the optical detector 123 is adjusted, e.g., blocked, when the second protrusion 76A begins to be detected by the optical detector 126. Based on this, the controller 90 determines the type of the ink cartridge 30A by referring to the look-up table stored in the ROM 92.

In the embodiments described above, the determined type of the ink cartridge 30 relates to the initial amount of ink stored in the ink cartridge 30, and the composition of ink, e.g., pigment-based ink or dye-based ink. In another embodiment, the type of ink cartridge 30 may relate to the color of ink stored in the ink cartridge 30.

In another embodiment, the type of the ink cartridges 30 may relate to the place of manufacture of the ink. When the place of manufacture is determined, such information is stored in the controller 90. If a quality problem occurs in the printer 10, and the printer 10 is returned to the manufacturer, the manufacturer can know the place of manufacture of the ink used in the returned printer 10 based on the information stored in the controller 90. Accordingly, studies of the quality problem may become easier.

In another embodiment, the type of the ink cartridges 30 may relate to the date of manufacture of the ink. When the date of manufacture is determined, such information is stored in the controller 90. If a quality problem occurs in the printer 10, and the printer 10 is returned to the manufacturer, the manufacturer can know the date of manufacture of the ink used in the returned printer 10 based on the information stored in the controller 90.

In another embodiment, the types of the ink cartridges 30 may relate to ink cartridge 30 for general user's use and ink cartridge 30 for maintenance operator's use. The maintenance operator is a person who is able to repair the printer 10 at the site of use. The maintenance operator may perform a special operation for repairing the printer 10. For example, when the ink cartridge 30 for the maintenance operator's use is mounted to the printer 12, special operations which cannot be performed by the general users such as a purge operation discharging a large amount of ink are authorized by the controller 90.

In another embodiment, the type of the ink cartridge may relate to air solubility of ink. If the ink has a low air-solubility, the ink chamber 36 may not be depressurized. In contrast, if the ink has a high air-solubility, the ink chamber 36 may be depressurized. A program for maintaining the recording head 21 is changed based on the determination of the type relating to air solubility of ink.

In the embodiment described above, the first protrusion 75, the second protrusion 76, and the detection target portion 147 that enter the detection areas of the optical detectors 123, 126, and 141 to block light, respectively. However, it is not necessary that these members completely block light emitted from light emitters toward the light receivers of the optical detectors 123, 126, and 141, respectively. For example, these members may make the intensity of light received by the light receiver less than a predetermined amount by blocking or attenuating light emitted by the light emitter by changing the altering the path of the light by reflecting or diffracting all or a part of the light or by attenuating the light using ground glass or a diaphragm.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink supply device comprising:

a cartridge mounting portion to which an ink cartridge is configured to be mounted;

a first detector configured to detect a first detection target portion of the ink cartridge and to output first detection information when the first detector detects the first detection target portion;

a second detector configured to detect a second detection target portion of the ink cartridge and to output second detection information when the second detector detects the second detection target portion; and a controller configured to perform a first determination process in which the controller determines that the ink cartridge is of a first kind if the first detection information begins to be output earlier than the second detection information begins to be output during the insertion of the ink cartridge into the cartridge mounting portion in the insertion direction, and determines that the ink cartridge is of a second kind if the second detection information begins to be output earlier than the first detection information begins to be output during the insertion of the ink cartridge into the cartridge mounting portion in the insertion direction.

2. The ink supply device according to claim 1, wherein the controller is configured to determine that the ink cartridge has reached a predetermined mount position in the cartridge mounting portion if both the first detection information and the second detection information are output.

3. The ink supply device according to claim 1, further comprising a third detector configured to detect a third detection target portion of the ink cartridge and to output third detection information when the third detector detects the third detection target portion, wherein the controller is configured to perform a second determination process based on whether the third detection information is output when one of the first detection information and the second detection information begins to be output during the insertion of the ink cartridge into the cartridge mounting portion in the insertion direction.

4. The ink supply device according to claim 1, wherein the ink cartridge comprises a first wall facing forward during the insertion of the ink cartridge into the cartridge mounting portion in the insertion direction, a first protrusion protruding from the first wall in the insertion direction, and a second protrusion protruding from the first wall in the insertion direction, wherein the first protrusion is the first detection target portion and the second protrusion is the second detection target portion.

5. The ink supply device according to claim 4, wherein the first protrusion of the ink cartridge of the first kind is longer than the second protrusion of the ink cartridge of the first type in the insertion direction, and the first protrusion of the ink cartridge of the second type is shorter than the second protrusion of the ink cartridge of the second kind in the insertion direction.

6. The ink supply device according to claim 5, wherein the first protrusion and the second protrusion having different lengths in the insertion direction are formed by breaking an end portion of one of protrusions at a breakable groove formed therein, wherein the protrusions protrude from the first wall in the insertion direction and have an equal length in the insertion direction, wherein the protrusions have the breakable grooves formed therein, respectively, at the same position in the insertion direction.

7. The ink supply device according to claim 4, wherein the first protrusion and the second protrusion are separated from each other in a vertical direction when the ink cartridge is in a predetermined mount position in the cartridge mounting portion.

8. The ink supply device according to claim 7, wherein one of the first protrusion and the second protrusion is positioned at an upper end of the first wall and the other of the first protrusion and the second protrusion is positioned at a lower end of the first wall when the ink cartridge is in the mount position in the cartridge mounting portion.

9. The ink supply device according to claim 4, wherein the ink cartridge comprises an ink supply portion positioned at the first wall and configured to supply ink stored in the ink cartridge to an exterior of the ink cartridge, and the ink supply portion is positioned between the first protrusion and the second protrusion.

10. The ink supply device according to claim 4, wherein each of the first detector and the second detector comprises a light emitter configured to emit light and a light receiver configured to receive the light emitted by the light emitter, the first detector detects the first protrusion when the first protrusion enters an optical path extending from the light emitter of the first detector to the light receiver of the first detector, and the second detector detects the second protrusion when the second protrusion enters an optical path extending from the light emitter of the second detector to the light receiver of the second detector, wherein a longer one of the first protrusion and the second protrusion comprises a light intensity adjuster configured to be positioned in the optical path of one of the first detector and the second detector and to adjust an intensity of light reaching the light receiver of the one of the first detector and the second detector when a shorter one of the first protrusion and the second protrusion begins to be detected by the other one of the first detector and the second detector, and wherein the controller is configured to perform a third determination process based on the intensity of light received by the light receiver of the one of the first detector and the second detector when the shorter one of the first protrusion and the second protrusion begins to be detected by the other one of the first detector and the second detector.

11. The ink supply device according to claim 4, wherein the first protrusion and the second protrusion are configured to be removal from the first wall.

12. The ink supply device according to claim 1, the ink cartridge comprises a first wall facing forward during the insertion of the ink cartridge into the cartridge mounting portion in the insertion direction, and a cover configured to cover the first wall, wherein the first detection target portion and the second detection target portion are positioned at a front side of the cover in the insertion direction.

13. A method of determining a kind of an ink cartridge configured to be mounted to a cartridge mounting portion, the method comprising:

a first step of storing in a storage medium first detection information output from a first detector positioned on the cartridge mounting portion during insertion of the ink cartridge into the cartridge mounting portion;

a second step of storing in the storage medium second detection information output from a second detector positioned on the cartridge mounting portion during the insertion of the ink cartridge into the cartridge mounting portion;

a third step of performing a first determination of determining the kind of the ink cartridge, wherein the ink cartridge is determined to be a first kind if the first detection information begins to be output earlier than the second detection information begins to be output during the insertion of the ink cartridge into the cartridge mounting portion in the insertion direction, and the ink cartridge is determined to be a second kind if the second detection information begins to be output earlier than the first detection information begins to be output during the insertion of the ink cartridge into the cartridge mounting portion in the insertion direction; and a fourth step of determining that the ink cartridge has reached a predetermined mount position in the cartridge mounting portion based on both the first detection information and the second detection information stored in the storage medium.

14. An ink supply device comprising:

a cartridge mounting portion to which an ink cartridge is configured to be mounted;

a first detector configured to detect a first detection target portion of the ink cartridge and to output first detection information when the first detector detects the first detection target portion;

a second detector configured to detect a second detection target portion of the ink cartridge and to output second detection information when the second detector detects the second detection target portion;

a third detector configured to detect a third detection target portion of the ink cartridge and to output third detection information when the third detector detects the third detection target portion; and a controller configured to perform a first determination process of determining a kind of the ink cartridge based on a temporal precedence between a time at which the first detector begins outputting the first detection information and a time at which the second detector begins outputting the second detection information during insertion of the ink cartridge into the cartridge mounting portion in an insertion direction, wherein the controller is further configured to perform a second determination process based on whether the third detection information is output when one of the first detection information and the second detection information begins to be output during the insertion of the ink cartridge into the cartridge mounting portion in the insertion direction.

* * * * *